US007243464B1

(12) United States Patent
Crowell

(10) Patent No.: US 7,243,464 B1
(45) Date of Patent: Jul. 17, 2007

(54) MODULAR BUILDING SYSTEM

(76) Inventor: James H. Crowell, 4629 SW. Lakeview Blvd., Lake Oswego, OR (US) 97035

( * ) Notice: Subject to any disclaimer, the term of this patent is extended or adjusted under 35 U.S.C. 154(b) by 0 days.

(21) Appl. No.: 10/009,369

(22) PCT Filed: May 10, 2000

(86) PCT No.: PCT/US00/12795

§ 371 (c)(1),
(2), (4) Date: Jun. 6, 2002

(87) PCT Pub. No.: WO00/68523

PCT Pub. Date: Nov. 16, 2000

Related U.S. Application Data

(60) Provisional application No. 60/133,306, filed on May 10, 1999, provisional application No. 60/185,250, filed on Feb. 28, 2000.

(51) Int. Cl.
*E04B 7/04* (2006.01)
*E04D 3/36* (2006.01)
*E04B 1/28* (2006.01)

(52) U.S. Cl. ..... 52/93.2; 52/262; 52/270; 52/461; 52/471

(58) Field of Classification Search ..... 52/79.1, 52/284, 92.1, 92.3, 286, 93.1, 93.2, 262, 52/270, 460, 461, 469, 471
See application file for complete search history.

(56) References Cited

U.S. PATENT DOCUMENTS 1,605,513 A 11/1926 Connery
3,286,423 A * 11/1966 Donlon ..... 52/286
3,397,496 A * 8/1968 Sohns ..... 52/286
3,812,631 A 5/1974 Cruse
3,898,779 A * 8/1975 Tracy ..... 52/92.3
3,998,016 A 12/1976 Ting
4,563,849 A * 1/1986 Mangal ..... 52/235
4,688,364 A * 8/1987 Fiehler ..... 52/573.1
4,796,403 A * 1/1989 Fulton et al. ..... 52/713
4,930,268 A * 6/1990 Fritz et al. ..... 52/93.2
5,129,204 A 7/1992 Palumbo
5,274,974 A * 1/1994 Haag ..... 52/284
5,575,127 A * 11/1996 O'Neal ..... 52/573.1
5,640,823 A 6/1997 Bergeron et al.
5,729,944 A * 3/1998 De Zen ..... 52/309.17
5,743,063 A 4/1998 Boozer
5,829,216 A * 11/1998 Newcomb et al. ..... 52/395
5,867,949 A * 2/1999 Untiedt ..... 52/93.2
5,921,047 A * 7/1999 Walker ..... 52/284
6,119,410 A * 9/2000 Wolfe ..... 52/588.1
6,298,619 B1 * 10/2001 Davie ..... 52/284
6,314,704 B1 * 11/2001 Bryant ..... 52/284

* cited by examiner

*Primary Examiner*—Michael Safavi
(74) *Attorney, Agent, or Firm*—Kolisch Hartwell, P.C.

(57) ABSTRACT

A modular building system (100) including preformed extrusion-molded polymeric material (116). Parts include integral connector elements (160, 162) which can be slidably and snappingly reversibly interconnected to form the basic frame (102) and panel structures (108) of an overall building. The interconnected region permits limited ranges of angular as well as translational relative motion between adjacent, connected elements. Parts are assembled simply and quickly in the field, without requiring skilled labor or specialized tools, to form a functionally solid and stable building which responds to loads and temperature changes with yieldable, accommodating deformations that minimize the likelihood of building structural damage, and effectively transmit necessary loads to the ground via load-transfer paths through the building.

5 Claims, 19 Drawing Sheets

MODULAR BUILDING SYSTEM

CROSS-REFERENCE TO RELATED APPLICATION(S)

This application claims the benefit of prior-filed U.S. provisional application Ser. No. 60/133,306, filed May 10, 1999, entitled "Polytech Systems Construction Method", and Ser. No. 60/185,250, filed Feb. 28, 2000, entitled "Insulated Shallow Foundation System". The entire contents of these two provisional applications are hereby fully incorporated by reference into the disclosure of this case.

BACKGROUND AND SUMMARY OF THE INVENTION

This invention pertains generally to a unique modular building system, and to buildings which can be constructed from the modular elements of that system. In particular, the invention relates to such a system which includes a relatively small number of different parts, many of which are preferably formed of an extrusion-molded polymeric plastic material. Such extrusion-formation of these system parts is especially promoted by the fact that the proposed structural elements in this system, or at least most of them, are slender elongate elements which have uniform cross sections throughout their entire respective lengths. Certain ones of the building components, or elements, of the present invention are employable interchangeably and differentially in different specific operational settings in a building constructed in accordance with the invention, including in settings with one another wherein they are joined to form and coact as structural frame components, such as columns, beams, rafters, etc. These special invention components thus lead to an overall system which requires only a modest inventory of differentiated parts, and which, nevertheless, produces a system offering a large range of operational versatility in terms of the constructions of different kinds of final overall buildings.

In general terms, the system of the present invention includes, in an assembled overall building, a skeletal framework structure formed of long slender parts, and of cooperative assemblies of plural, selected ones of such parts, that act, inter alia, as horizontal foundation components, as upright columns, as horizontal beams, as inclined rafters, as perimetral boundary frame elements for and in different kinds of planar, framework-spanning panels (spanner elements), and as connective interfaces along the confronting long edges of adjacent panels.

Extending integrally along selected sides or edges of these parts are nominally exposed and accessible connector elements which can selectively coact, in a reversible, relatively sliding and/or snap-together fashion, with counterpart connector elements present in adjacent parts, all for the purpose of joining such adjacent parts. Such joined/interconnected parts can be thought of (from one point of view) as being joined through what are sometimes referred to herein as being receptive-channel, received-flange-type connectors.

Assembled slid/snapped-together parts, in relation to the kinds of configurations proposed for their associated connector elements according to the invention, are intentionally permitted certain limited ranges of angular and/or translational (in several directions) relative motion. The important reasons for making such limited relative motions possible will be described more fully shortly. This snap/slide-together kind of assembly procedure is quickly and easily performed to assemble individual parts into the forms of framework elements, such as the previously-mentioned columns, rafters, panel frames, etc., and to join such frame structural components with selected, different, broad-area panel structures. Easy component assembly (which is, for the most part, non-destructive reversible assembly) can be performed by relatively unskilled labor, and with no requirement for specialized tools. Whole buildings are easily put together with relative ease on different kinds of selected building sites, with foundation placement made especially easy because of certain convenient leveling and stabilizing features offered by the system of the invention.

Panels which are assembled to span different generally planar spaces that are defined, and which exist, between different stretches or groups of elongate framework parts, are floatingly (for permitted relative-motion purposes) and reversibly, though captively, disposed in such spaces. Importantly, and as distinguished from related prior art structures, such floating but captured dispositions for such panels promotes, in an overall building constructed with components made in accordance with this invention, a significant relative-motion response capability in that building with respect to both different kinds of externally applied loads, and to the effects on materials of changes in ambient temperature.

The facts that substantially all of the fundamental building elements of the system can be formed, and preferably are formed, by an extrusion-molded polymer material, and that a high degree of interchangeability and multiple-use possibility attaches to these elements, lead to a system which not only is relatively simple in fundamental construction, but also one which, from many points of view, is very inexpensive, and can lead to the constructions of buildings which also are relatively and strikingly inexpensive.

The fundamental modular building components in the system of this invention are, because of the presence of the above-mentioned slide/snap-together connector elements, easily and quickly assembled in varieties of different ways to form myriad types of buildings without the need for additional fasteners. Because of these novel connector elements, a building formed in accordance with the system of the invention can be assembled, on site, by relatively unskilled labor (as was earlier mentioned), and in a very short period of time in relation to conventional building approaches.

Very interestingly, when components constructed in accordance with this invention are fitted together (interconnected) on a job site to create a building, the interconnected components effectively snap and slide together into final, properly structurally and soundly connected relationship. Ultimately in a completed building, the components in each pair of adjacent components are permitted certain limited ranges of unrestrained relative motion with respect to one another.

One important consequence of this condition is that a building constructed in accordance with this invention is internally shiftable and changeable in configuration. Such a building can effectively change its size both in an enlargement sense and in a shrinkage sense in response to an applied external load, and to other phenomena, such as ambient temperature changes. These operational and performance qualities thus produce a building structure which reacts and responds in very unique ways regarding external phenomena of the types just generally mentioned.

Thus, and with very few exceptions, all interconnections created in a building so constructed are intentionally established through clearly load-bearing-capable, though relative-motion-permitting, interlock connections—a feature sharply distinguishing this system from prior art systems wherein interconnected components (or elements) are, for the most part, fixedly anchored to one another against any permitted relative motion. These connections offer substantial structural integrity in the sense of vigorously resisting accidental disconnection.

Not only do the components of the present system thus create a unique shiftable-configuration overall building, but also they create a building which, in response to an applied external load, adaptively self-selects a most-appropriate load-bearing path through the system, which path is uniquely and directly related to the nature, size and point of application of such a load. For example, differently directed loads applied to the very same point of application in a building constructed in accordance with this invention will seek different load-bearing paths through the structure. This unique behavior is especially promoted by the ubiquitous relative-motion interconnection characteristic of the building, and by the natural, resulting selective "bottoming-out" (ending of relative-motion capability) between relevant, adjacent, affected components that define the resulting load-bearing path. The building thus "chooses" different, most-appropriate load-reaction paths "on the fly", so-to-speak, as loads are exerted on the building.

A number of important consequences flow from this path-choosing capability. One is that the most appropriate load-reaction path required for a given applied load will substantially always be selected. Since such a path is basically selected through a particular combination of (but not all) interconnected building elements, there are always other elements not required for use in such a load-reaction path. These other elements are therefore effectively unloaded by that load, and thus are in "dwell" periods regarding load transmission. Accordingly, over time, each component in a building constructed in accordance with the system of this invention is called upon perhaps only infrequently to carry a load, and thus potentially has a significantly longer effective operational life-span than would a comparable component in a more conventional structure where rigid interconnection is "the rule of the day".

When deformation-creating loads are applied to a building constructed with components offered by the system of this invention, various interlock connections that are present between adjacent components in the building effectively tighten and become more "solid" and "robust". Associated panels are placed more fully in tension to carry and distribute such loads, and accordingly, these panels offer what can be thought of as high-level reactive responses to such loads. The term "high-level" is employed herein to emphasize the fact that a panel so placed in tension operates desirably in what may well be, and often is, its maximum-capability load-handling mode of behavior. In other instances, a panel may bow in its perimeter frame to accommodate a load. Such bowing is freely permitted by the fact that the panel expanse effectively floats in its perimeter frame.

Also proposed by the system of the present invention are several distinct embodiments of ground-engaging foundation structures, certain ones of which result in the superstructure in the building, i.e., that structure which rests upon the foundation, being elevated above the ground (for low-level ventilation), and other ones of which permit the superstructure of the building to rest simultaneously both on the foundation and upon the underlying ground. These several different modifications include both ground-penetrating and non-ground-penetrating possibilities for foundation construction.

Delivery structures (fluid conduits, wires, etc.) employed for conducting and conveying conventional utilities which may be furnished in a particular building such as water, electricity, gas, heating and cooling, fire suppression, television, cable and telephone lines, and so on, are accommodated by self-establishing and pre-configured ways and chases provided, by intentional design, within the various building components. Such ways and chases are pre-designed, according to the invention, into, and with respect to, these building components, and they effectively come together into an organized whole automatically as interconnecting components are brought together to form a building. These utility-accommodating passages form a logical vertical and horizontal utility distribution network throughout a building, and this network is constructed in a manner which makes the ways and chases readily accessible both during initial building construction, and later on if and when utility routing changes are desired. Preferably, and at appropriate locations within a building constructed in accordance with the invention, different required utilities are distributed in what is referred to herein as a manifold-delivery way.

Void spaces intentionally provided in wall panel structures, and in columns and regions of joinder between two adjacent panels, allow for the ready flow of air, and drainage of water. Draining water both from such wall, column and joinder regions, as well as any water that requires drainage from within a building's floor structure, flows by design downwardly into passages made directly accessible in the foundation structure, thus to allow for confident, automatic water discharge from regions in a building where it could eventually (or even in a short period of time) cause serious problems.

The various different building structures whose assemblies are made possible by the system of present invention can uniquely include a number of additional, very interesting features. For example, the novel foundation structure proposed by the invention is one which can be equipped with appropriately controllable vents or ports that allow for the flow of air under flooring in the system, and for the containment (in large reservoirs) of stored water which may be employed for fire-suppression purposes, for heat-sinking and temperature-stability purposes, and for anchor-weighting of a building which may, for example, sit directly on top of the ground.

A structure constructed in accordance with the system of this invention also allows for easy incorporation into a building of various moveable structures, such as moveable panels/screens which can control the amount of light admitted at different locations, and for other purposes. Buildings can, because of convenient system modularity and versatility, be differently rendered in different climates to achieve maximum environmental (such as solar) efficiency. Walls within the overall building (internal walls), as well as external walls, can easily be removed, added, repositioned, etc. substantially without any destructive consequences, and freely at will over time. The respective placements or positions of certain panels can be changed as desired. For example, a panel containing a window and/or a door may readily be positionally switched with another kind of panel.

According to a preferred embodiment of a foundation structure constructed in accordance with this invention, the same takes the form of a two-component organization including a central solid core, preferably formed of poured concrete, and rigid-plate jacketing structure, preferably formed with several components created out of molded and extruded polymeric material. This jacketing structure coacts with the core to transmit overhead superstructure loads to the ground. Such two-component foundation structure preferably has a lateral outward flare, or splay, progressing downwardly through it from the region of the superstructure to the ground. With such a flare, and because of the presence of the lateral jacketing structure, this kind of foundation structure delivers load to the ground in a unique fashion. Specifically, such a foundation employs and permits various respective and differentiated reactions to loads that need to be transmitted to the ground, all as determined by the direction and character of such a load, and all in relation to the cooperative but differentiated handling of loads, on the one hand by the core, and on the other hand by the jacketing structure. A foundation structure constructed in this fashion itself offers a degree of variable selection of the most efficient and effective path through the foundation for the transmission of loads to the ground.

The use of polymer plastics to form substantially all of the fundamental building components proposed in accordance with this invention results in a created building construction which is especially resistant to decay, to other deterioration, to insect invasion, and to other invasive and lifetime-shortening problems that are associated with many of the usual materials found in a conventional building structure.

As was mentioned earlier, building assembly (construction) in the field is characterized by quick and easy slide/snap-together interfitting of components. Such activity, as has already been stated, requires no specialized tools or costly labor. It also avoids conventional time-consuming on-site fabrication procedures, such as the cutting and fitting of parts.

Components that are shipped to a job site for assembly into a building can be shipped very handily in "disassembled", low-volume-occupying space, and thus can be transported effectively as a pile or collection of components stacked, for example, in conventional load containers.

Many other features and advantages that are realized and offered by the system of the present invention will become apparent as the description which now follows is read in conjunction with the accompanying drawings.

DESCRIPTION OF THE DRAWINGS

FIG. 44 is taken generally along the line 44—44 in FIG. 43.

DETAILED DESCRIPTION OF AND BEST MODE FOR CARRYING OUT, THE INVENTION

Figure 1:
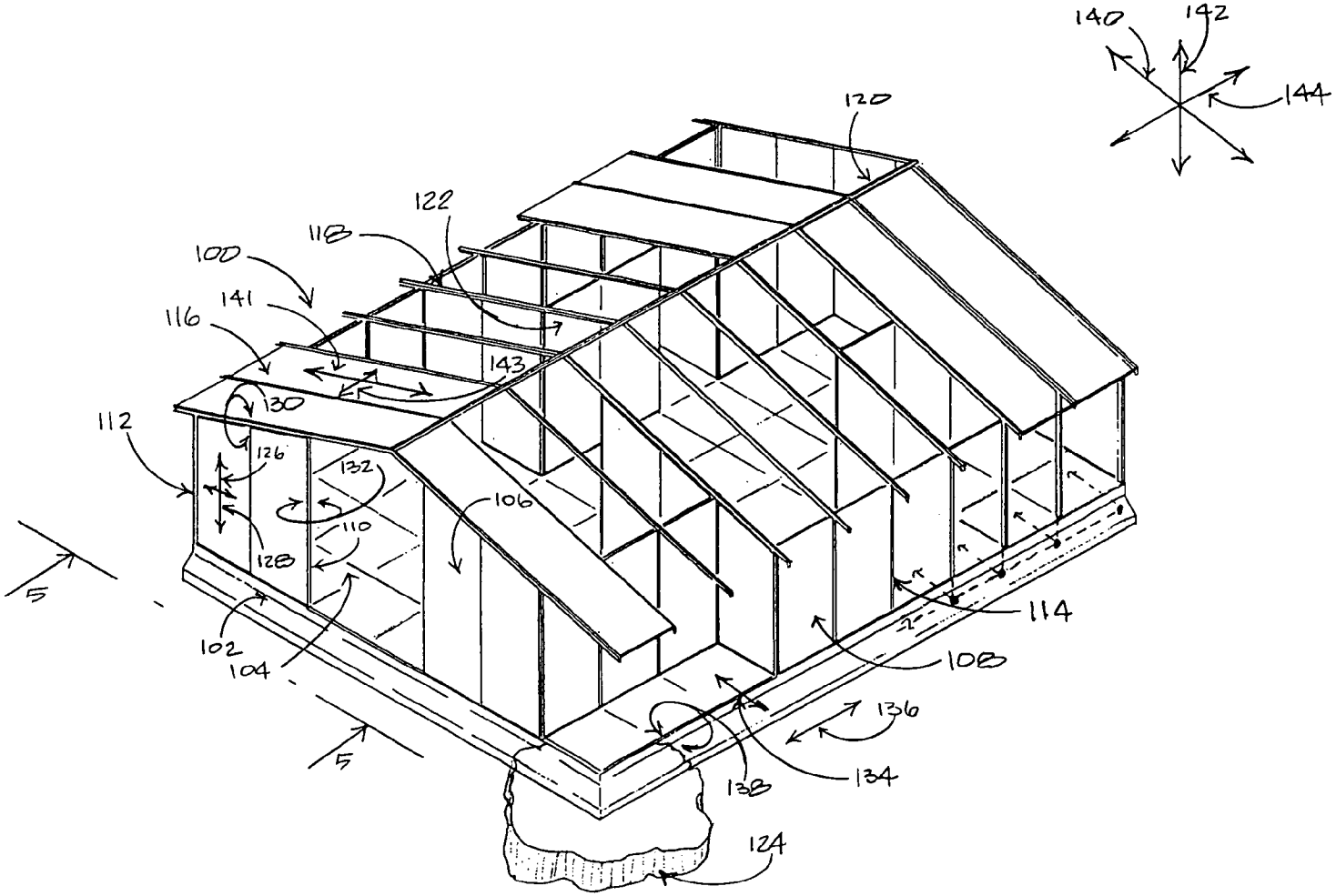
FIG. 1 is a simplified, fragmentary top-perspective view of a building constructed with modular building components formed in accordance with the present invention. Only certain selected parts and regions of this building are shown in this figure (others being removed/omitted) in order to use this figure generally and effectively to offer a general overview of an organization of structural components illustrating the versatility of the invention.

Turning attention now to a detailed description of the present invention, the same is specifically illustrated and especially described herein in conjunction with the several numbered drawings views which have just been identified above. As will be appreciated by those generally skilled in the arts which are relevant to the field of the present invention, these drawings, or at least many of them, have been prepared substantially at the level of conventional architectural/engineering building drawings, with clearly sufficient detail to inform such people exactly how the pictured structures are formed and inter-related. Not all of the details thus specifically presented in these more detailed drawings views need necessarily be described with any elaboration in order for one to understand the elements and principles of the present invention, and accordingly, and in order to maximize clarity and minimize having to deal with unnecessary excess information, such additional details pictured in the drawings are not specifically talked about in the text which now follows. Also, where the same or different particular drawings views illustrate constructional features of the present invention which appear at several locations in the drawings, while these locations are selectively pointed out herein, unnecessary repetitive detailed description for each has been intentionally omitted, also with the intention of promoting clarity in the exposition of this invention.

As an additional matter accompanying the specification, claims, text and abstract in this application is a section identified as an Appendix which contains a collection of unnumbered architectural/engineering drawings views, some of which have been employed in an extracted and focused fashion to create the specifically numbered drawings views mentioned above. These Appendix drawings provide an additional rich and fully expressive collection of material further aiding in disclosing the character and scope of the present invention. These drawings, just as is true with certain ones of the numbered drawings views herein, are in a conventional form, and are easily read and understood by persons in the category mentioned above as being those generally skilled in the fields of art associated with the instant invention.

Pictured in FIG. 1 in the drawings is an overall building 100 which has been constructed utilizing components constructed in accordance with the present invention. Building 100 includes a foundation structure 102, a floor structure 104 resting on the foundation structure, outside end wall and side wall structures, such as those shown at 106, 108, respectively, rising upwardly from the foundation and floor structures, upright outside end wall, corner and side wall columns, such as those shown respectively at 110, 112, 114, roof panel structure 116, roof-supporting elongate rafter structure 118, roof ridge beam structure 120, and interior wall panel structure, such as that shown generally at 122, extending generally between floor structure 104 and roof panel structure 116.

In general terms, the various building structural elements or components progressing from the floor structure upwardly to and including the ridge beam structure are collectively referred to herein as superstructure, and these are, of course, supported, at least in part, on foundation structure 102. In the particular building, building structure 100, illustrated in FIG. 1, foundation structure 102 resides in a category referred to herein as a ground-contacting, ground-penetrating structure which is embedded into the ground in such a fashion that, essentially, the bottom expanse of building 100 immediately underneath the floor structure rests, as will soon be described, on the underlying ground which may be prepared, for leveling and adequate support purposes, with a particulate material such as sand and/or gravel. Embedment, thus, of foundation structure 102 is illustrated and suggested by the fragmentary showing at the lower side of FIG. 1 of the underlying ground, pictured generally at 124.

Briefly mentioning at this point several other things which are illustrated in FIG. 1, toward the left side of FIG. 1 there are shown two double-ended crossed arrows 126, 128, and a pair of double-ended curved arrows 130, 132. Toward the lower side of FIG. 1 are shown two differently directed double-ended straight arrows 134, 136, and a double-ended curved arrow 138. Toward the upper right corner of FIG. 1 there are shown three orthogonally intersecting double-ended straight arrows 140, 142, 144. On the left side of the roof structure pictured in FIG. 1, appear two orthogonally intersecting arrows 141, 143. As will become more fully apparent in the description text given below, these arrows will be understood to be illustrative of relative-motion and related configurational-change activities that are permitted to occur in building 100.

Specifically, these several straight and curved arrows are employed herein to explain and describe certain relative-motion and configurational-change behaviors that are uniquely exhibited by the system of the present invention in the form, as now being described, of building 100 under circumstances when that building is subjected to various potentially deformation-creating forces, such as wind forces, earthquake forces, ambient temperature changes, falling and otherwise impacting objects, and other kinds of circumstances. These relative-motion and configurational-change capabilities are furnished as a consequence of the unique manners in which all of the several basic component parts of the system of this invention which make up building 100 join with one another in the final overall building structure.

Illustrated near the right side of FIG. 1, and pictured fragmentarily and specifically in a lower corner region of building 100 by dashed lines which intersect at enlarged dots, there is shown a portion of one of the several different utility distribution structures that are furnished in building 100 in the manner which is referred to herein as a manifold distribution manner. As an illustration, these several dashed lines might, for example, reflect the positions of manifold delivery conduits associated with a fresh water delivery systems. As will become apparent from the description which follows below, and from a review of the various drawings presented in the specification, void spaces that are present in various ones of the several building components that make up a building like building 100 afford adequate and versatile space for the incorporation of such manifold structure.

Figure 2:
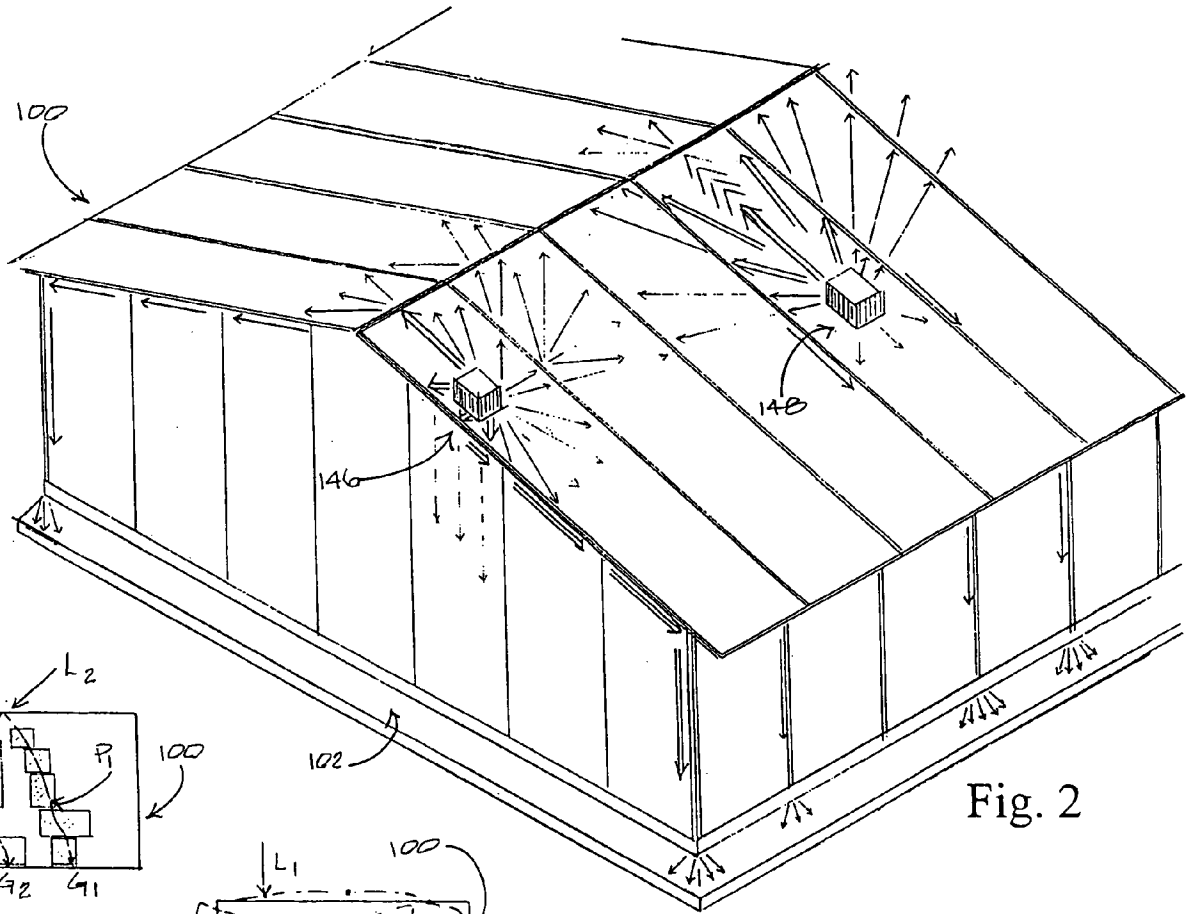
FIG. 2 is another fragmentary view of the building of FIG. 1, illustrating reactive load-handling responses produced by that building in relation to the application of two different specifically applied "overhead" external (on the roof structure) loads.
Figure 3:
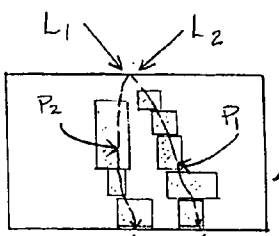
FIG. 3 is a simplified, block/schematic, story-telling view illustrating how building components constructed according to the present invention, incorporated into the building of FIGS. 1 and 2, respond to create different, specific, load-bearing paths through the building between the point of external load application and the ground.
Figure 4:
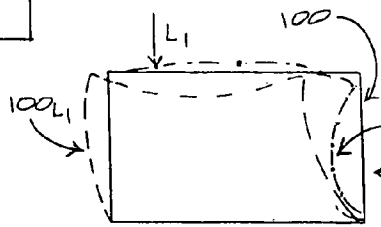
FIG. 4 is a simplified, block/schematic, story-telling view illustrating, under two different conditions of external load application, unique configurational-change, and size-change, responses that are offered by the building of FIGS. 1 and 2 in accordance with the performance of parts made according to the present invention.

Turning now for a moment to FIGS. 2, 3 and 4, these three views further illustrate load-response characteristics of a building such as building 100. FIG. 2 specifically illustrates building 100 in a somewhat more completed form, and demonstrates certain kinds of load responses which are performed by this building as a consequence of two differently applied roof loads pictured generally at 146, 148 in FIG. 2. These roof loads came bowing deflection of the related underlying roof panels, and delivery of loads to the ground along different paths through the structure of building 100. Such paths are pictured in FIG. 2 by arrays of arrows.

FIG. 3 illustrates in an exaggerated and story-telling way how the components, or certain ones of the components, in building 100 coact according to the invention to define different load-reaction paths through the building between a single point of overhead external load application with respect to which two differently directed loads, labeled $L_1$, $L_2$, are applied. Load $L_1$ in FIG. 3 is reacted to by relative motion activities in a certain collection of parts and components in building 100 to create what can be thought of as a stacked collection of building components with respect to which bottoming out has occurred, i.e., relative motion has reached the limits of possibility, to establish a load-transfer path $P_1$ between load $L_1$ and ground point $G_1$. The "stacked" components are represented by the small rectangles aligned along path $P_1$.

Reaction to load $L_2$ takes place through another "stacked collection" of interengaged components in building 100 to define another load-reaction path $P_2$ which extends through building 100 from the point of application of load $L_2$ to a different ground point, designated $G_2$ in FIG. 3. Building 100 thus effectively chooses, on the fly, the most appropriate load-reaction path to employ for handling each one of loads $L_1$ and $L_2$, and effectively requires only the best suited limited number of building components to transfer these loads. Other components in the building are effectively unloaded specifically by these loads, and thus are in the mentioned dwell periods respecting times of load transmission experienced throughout the life of building 100 by the various elemental building components in the building.

FIG. 4 is also a schematic story-telling view illustrating another response characteristic of building 100 promoted by the features of the present invention. Here, two differently located loads $L_1$, $L_2$ are pictured applying loads, respectively, to the upper portion and to the right-side portion of the building as such is pictured in simplified block form in FIG. 4. Upper load $L_1$ is represented by a dashed-line arrow, and load $L_2$ by a dash-dot line arrow.

The building in an unresponsive state with respect to either one of loads $L_1$, $L_2$ is represented by the rectangular solid outline presented for the building schematically in FIG. 4. Response by the building to load $L_1$ is pictured in a highly exaggerated fashion by the dashed-line distortion shown at $\mathbf{100}_{L1}$. Similarly, distortion and load-response reaction of the building under the influence of load $L_2$ is pictured by the dash-dot line designated $\mathbf{100}_{L2}$.

These two exaggerated, but accurately otherwise, representative pictures of building distortion show that building 100 reacts variously to an applied load, such as loads $L_1$, $L_2$ by changing its overall configuration, and where appropriate, by shrinking and/or enlarging in overall size in various regions of the building. These responses are uniquely promoted by the relative-motion interconnect structures featured as an important contribution of the system of the present invention.

Figure 5:
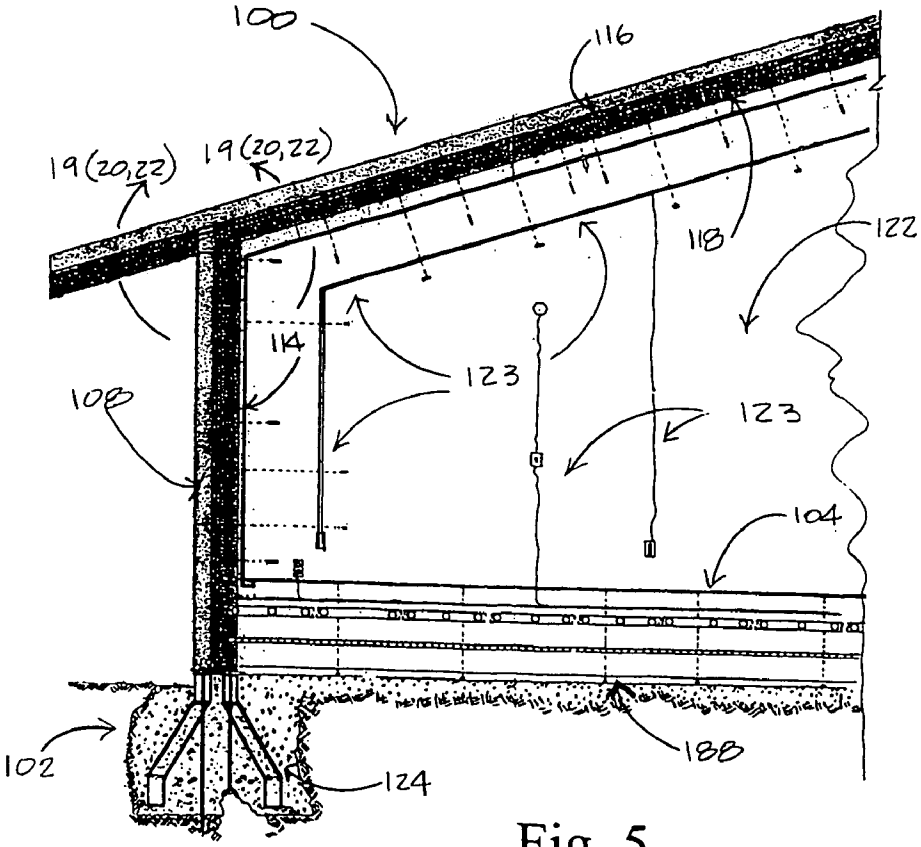
FIG. 5 is a fragmentary, elevational cross section taken generally along the line 5—5 in FIG. 1, illustrating the organization of certain components visible in a transverse vertical plane intersecting the building of FIGS. 1 and 2.

Continuing now with a focus directed toward FIGS. 5–13, inclusive, the section view presented in FIG. 5 of building 100 further shows the organization in that building of foundation 102, floor structure 104 (exploded vertically), an outside wall column structure 114, an outside wall panel structure 108, an inclined rafter structure 118, and a roof panel structure 116. An inside wall panel structure is shown generally at 122.

Also generally illustrated in FIG. 5, and pointed to very generally by arrows 123, is an exploded representation of various components in utilities distribution structures in the categories mentioned earlier, which structures are threaded through appropriate accommodating spaces in the various building components in building 100 such as the floor structure, the wall structure, the column structure and the rafter structure.

Figure 6:
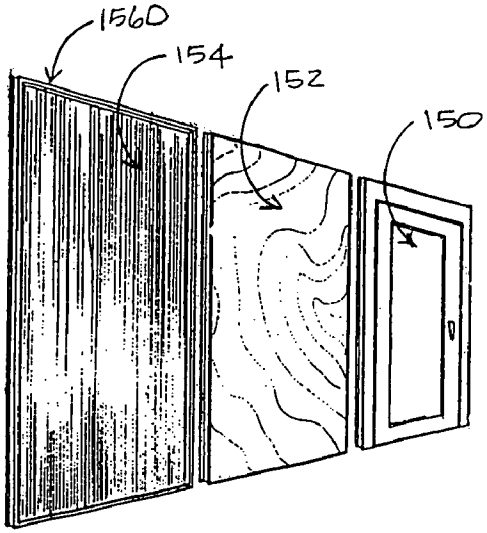
FIG. 6 is an isolated and detached perspective view of three different illustrative kinds of panel structures which are constructed in accordance with the present invention—which panel structures may form part of the building shown in FIGS. 1, 2 and 5.

FIG. 6 pictures, in perspective, three isolated different panel structures constructed in accordance with this invention, generally aligned in side-by-side horizontal relationship, and including a door panel structure 150, a solid, non-light-passing panel structure 152, and a transparent light-passing panel structure 154. Particularly relevant to the present invention in relation to these three panel structures is that each of these panel structures is formed around its perimeter by a bounding frame or framework, such as the frame shown generally at 1560 surrounding the central spanner portion of panel structure 154. As will be more fully explained shortly, this perimeter frame structure is constructed from elongate, extrusion-molded polymer components that are built strictly in accordance with the present invention, and that are appropriately interconnected to create a completely encircling panel frame structure.

Figures 7, 8, 9:
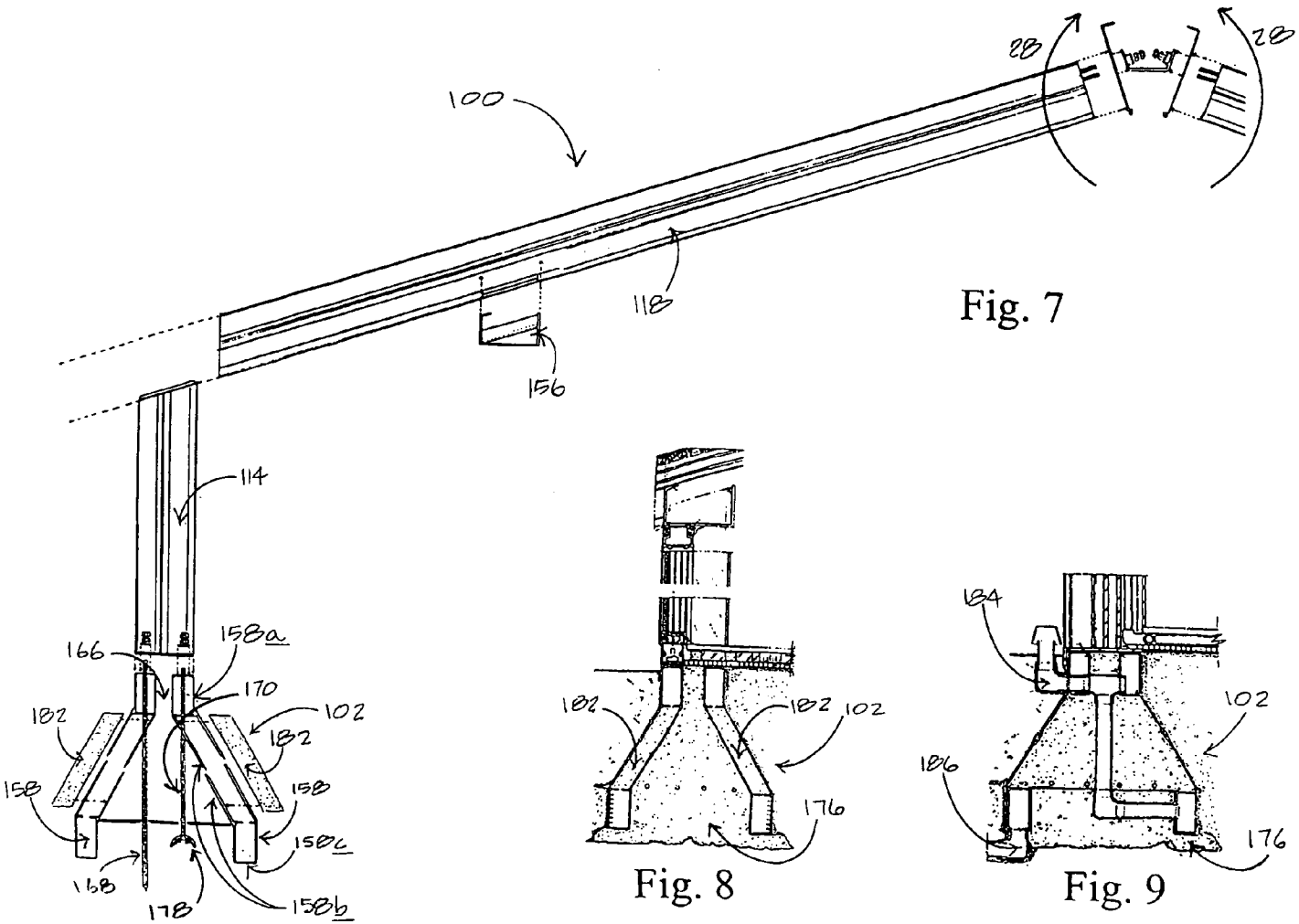
FIG. 7 is an enlarged, fragmentary and somewhat exploded and disassembled view isolating, and further showing, details of construction of certain invention component elements present in the building structure of FIGS. 1, 2 and 5.
FIG. 8 is a view, on roughly the same scale employed in FIG. 7, illustrating certain details of construction in a region where the foundation, external wall and floor structures in the building of FIGS. 1, 2, 5 and 7 come together.
FIG. 9 is a view which is very similar to that presented in FIG. 8, here illustrating a particular preferable set of features provided in the foundation structure of the building so far illustrated, and specifically showing features which address both radon-venting, and water-drainage.

FIG. 7 is a partially disassembled exploded view which further pictures certain components also pictured in the section view of FIG. 5. Thus, in FIG. 7, the following previously-mentioned structural components are illustrated: foundation structure 102, column 114, and rafter 118. An internal eave beam structure is shown disposed beneath rafter 118 at 156, and the ridge region in building 100 is resident generally within the area embraced by the two curved arrows labeled 28—28 in FIG. 7.

Referring now very specifically to FIGS. 7, 8 and 10–13, collectively, foundation structure 102 takes the form of a two-component foundation structure built in accordance with a preferred embodiment of the present invention. Specifically, foundation structure 102 effectively supports the superstructure in building 100 so that it rests both on this foundation structure and on the underlying ground 124. The components that make up what can be thought of as the outside structural portions of foundation structure 102 are formed of molded polymeric material, and are interconnected with one another in a manner shortly to be described to form a perimeter frame that rests solidly on and within the underlying ground to support building 100.

Foundation structure 102 includes a plurality of groupings of laterally spaced outer jacketing lateral structures, such as those shown at 158 that are formed with generally parallel, spaced, rigidly connected angular planar plate portions such as the three plate portions shown at 158*a*, 158*b*, 158*c* that are disposed relative to one another in a somewhat flattened Z-shaped configuration. Preferably, these structures that are numbered generally 158 include substantially matching counterpart upper and lower portions that are brought together to form the overall shape, and this construction is shown especially in FIG. 11 in the drawings. The upper and lower components which collectively form these now-being-described parts of the foundation structure are suitably joined to one another in any appropriate manner.

Figure 13:
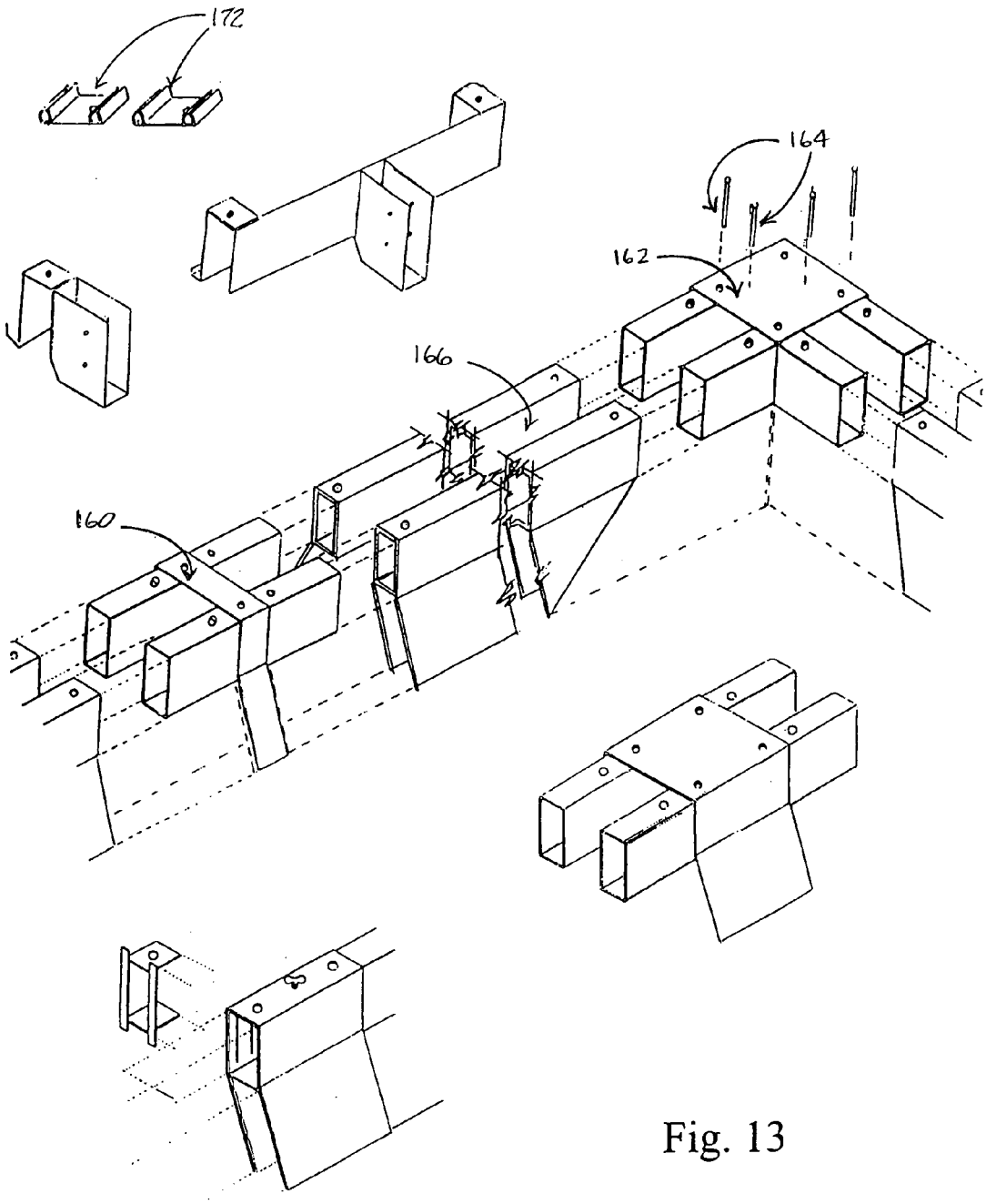
FIG. 13 is a multi-element exploded view generally picturing the organization of certain components or parts created in accordance with the present invention and utilized (in an interconnected fashion) to form the foundation for the building illustrated in FIGS. 1, 2, 5 and 7.

As can be seen especially in the exploded illustration presented in FIG. 13, these angular lateral structures form the opposite outer jacketing sides of the overall foundation structure, and they are joined to one another preferably in a telescopic fashion by appropriate linear and angular telescopic connectors, such as the two shown at 160, 162 in FIG. 13. Within the overall foundation structure, these several components, whose respective constructions are quite self-evident as pictured in FIG. 13, are suitably anchored relative to one another by any appropriate joining mechanism, such as by locking pins like those shown generally at 164 in FIG. 13.

Along the sides and ends of the foundation structure with the components therein just described in their appropriate positions relative to one another, open spaces, such as that generally pointed to at 166, expose the regions between Z-shaped side components, thus enabling these components to accommodate the pouring of what will become a solid core material in the foundation, such as concrete. After pouring and curing of such concrete, the foundation structure essentially becomes a two-component structure including a core and lateral jacketing structure, which jacketing structure splays outwardly progressing downwardly through the foundation structure to transfer loads to the ground differentially through each of these two basic component contributors in the foundation structure. Significantly aiding in speeding up the process of construction of a building made in accordance with the present invention, it will be apparent that the lateral perimetral jacketing structures just described can easily and quickly be put into place on or within the appropriate ground site. Concrete can then poured into the spaces just mentioned, with the lateral jacketing structure acting effectively as a form for pouring, and permitting other important construction activities, such as the back-filling of earth in and around the foundation, to take place immediately, inasmuch as these foundation components which will become permanent parts of the ending foundation fully protect the curing concrete core material.

Figure 10:
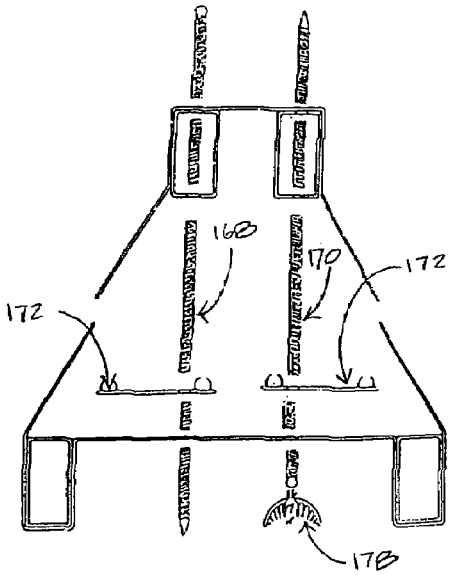
FIGS. 10 and 11 are two different views isolating and illustrating certain components that form portions of the foundation structure pictured for and in the building of FIGS. 1, 2, 4 and 7. These views are presented on a larger scale than that which is used, for example, in FIG. 9.
Figure 12:
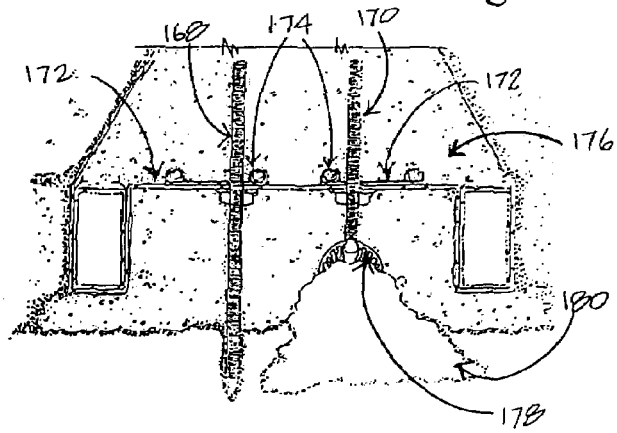
FIG. 12 is a fragmentary view, on a somewhat larger scale than that employed in FIGS. 10 and 11, illustrating in further detail (relative to FIG. 10) employment and use of a special foundation threaded-rod and foot component, referred to herein as an "octopus" structure, which allows for convenient temporary stabilization of unfinished foundation structure on and with respect to an underlying protrusion from the ground, such as the top of an exposed, ground-embedded rock.

Elongate bolts, such as those shown at 168, 170 in FIGS. 7, 10 and 12, extend vertically through suitable accommodating bores provided in selected ones of similarly shaped, related angular foundation components and downwardly into the region where concrete is poured, to become securely anchored in the foundation when poured concrete has in fact cured. These bolts, through the adding of appropriate sets of nuts along their lengths allow for very easy and convenient and accurate permanent leveling of the overall foundation structure on the selected building site.

Shown generally at 172 in FIGS. 10, 12 and 13 are shelf-like holders that are carried as shown on the just-mentioned bolts to hold conventional reinforcing rebars within the concrete core—such rebars being shown generally at 174 in FIG. 12.

Cured concrete in foundation structure 102 is shown generally at 176.

Disposed according to one unique feature of the present invention at the lower end of bolt 170 in FIGS. 7, 10 and 12 is a moderately broad adaptive foot, also referred to herein as an octopus 178. Octopus 178 is formed with downwardly extending elastomer tentacles that can be driven downwardly against a projecting underlying structure, such as the rock shown at 180 in FIG. 12, to accommodate free positioning of the overall foundation structure even where it directly overlies such a protruding structure. In FIG. 12, octopus 178 is shown in a condition thus engaging the top projecting surface of rock 180. The presence of the mentioned elastomeric downwardly extending tentacles in the octopus accommodate confident stabilizing of bolts, such as bolt 170, in a vertical sense during pouring and curing of the concrete core material in the foundation.

Figure 11:
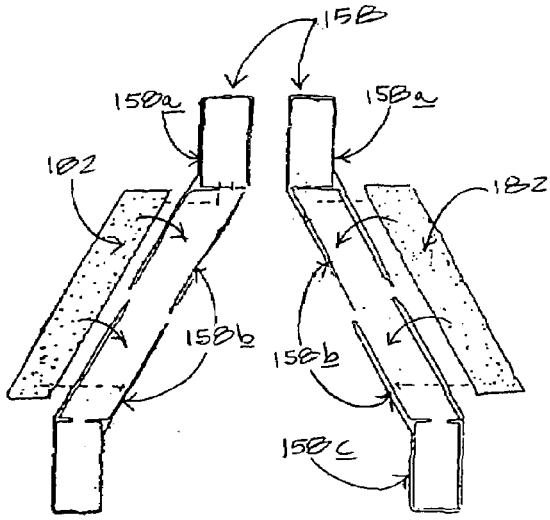

Appropriately and preferably positioned within the otherwise void spaces that exist in the regions laterally bounded by portions 158*b* in the Z-shaped foundation structures mentioned earlier, are elongate runs of any suitable thermal insulating material, such as the blocks of insulating material shown generally at 182 in FIGS. 7, 8 and 11.

FIG. 9, with respect to foundation structure 102, illustrates how radon evacuation and water drainage can be provided in and with respect to the foundation structure. Specifically, indicated generally at 184 in FIG. 9 is an appropriate radon venting structure organization, and at 186 is water drainage structure. These structures may conveniently and appropriately be positioned at several different selected locations around the foundation structure.

Figure 14:
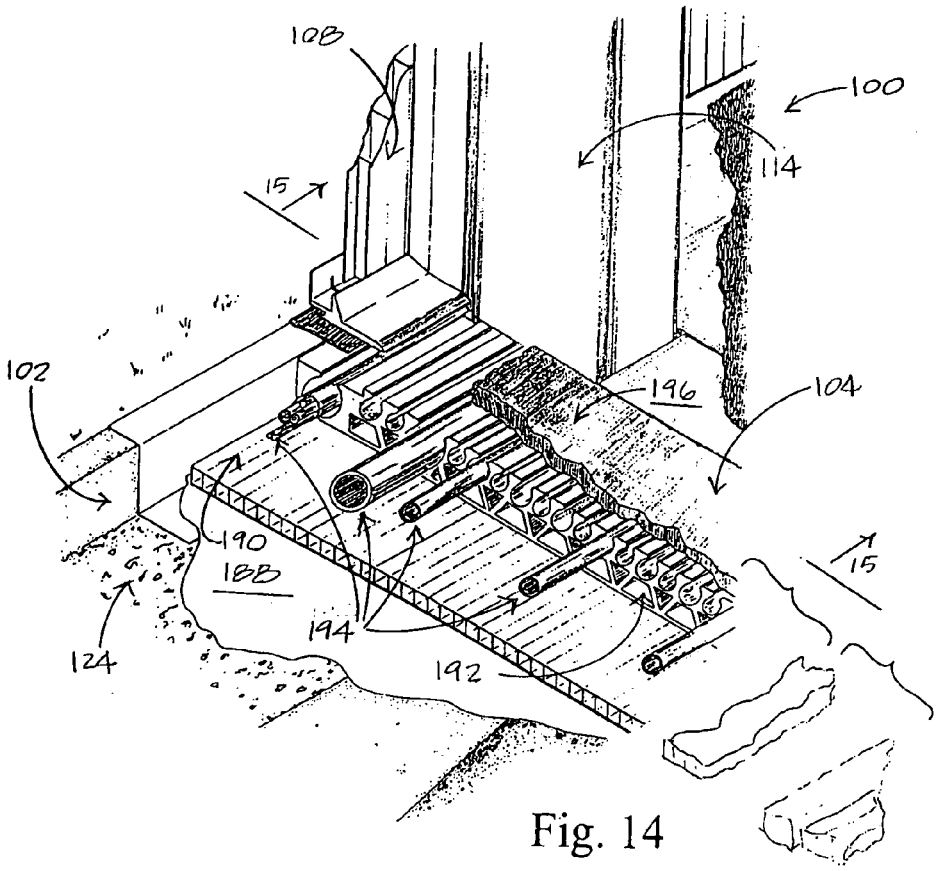
FIG. 14 is a more detailed view, roughly on the same scale as that which is employed in FIG. 13, showing, in fragmentary and perspective manners, and with portions broken away to illustrate details of construction, the construction of floor structure and related frame structure provided in the building of FIGS. 1, 2, 5 and 7.
Figure 15:
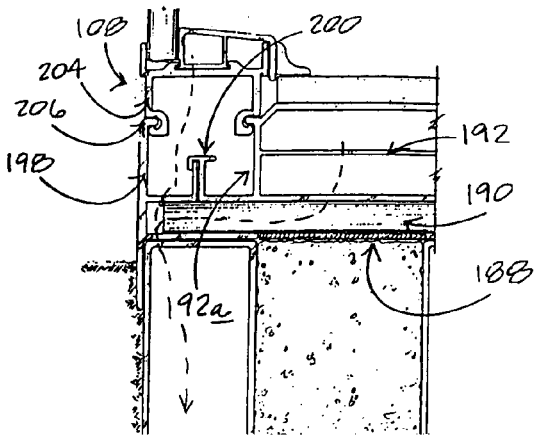
FIG. 15 is a somewhat enlarged, fragmentary, cross-sectional view, taken generally along the line 15—15 in FIG. 14.
Figure 16:
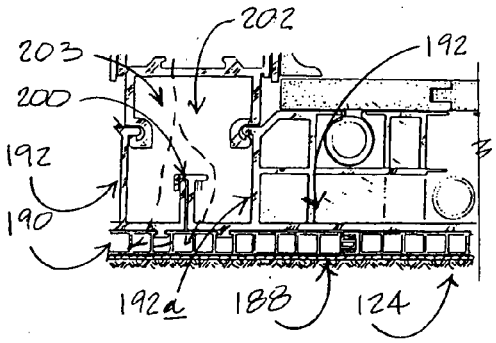
FIG. 16 is a view somewhat like that presented in FIG. 15, taken generally inwardly in the building from the point of view presented in FIG. 15, and specifically in a region which is toward the lower right corner of FIG. 15, illustrating the region of joinder or interconnection which exists between a pair of modular floor-panels (or tiles) employed in the building of FIGS. 1, 2, 5 and 7.

Considering now FIGS. 14–16, inclusive, here one can see how a preferred embodiment of foundation and ground-supported floor structure in building 100 are constructed. While there are many different ways in which a floor structure which is usable according to the teachings of the present invention, in building 100 floor structure 104 is, as a whole, an expansive layered structure that is made up of a plurality of generally rectangular flooring tiles which are themselves layered structures. A description generally of one only of these tiles will serve to describe this floor structure.

In the particular embodiment now being described in which the superstructure in building 100 rests at least in part on the underlying ground, lying immediately beneath floor structure 104, as a thin, distributed web of material, is a blanket 188 taking the form of a metallic foil outer material which contains inside it an insulating material. This blanket simply lies by gravity on the space over the ground spanned by foundation structure 102, and specifically and preferably lies on an underlying ground surface which has been prepared for the appropriate grade by spreading and grading thereon of a particulate material such as sand or gravel. The specific material employed in blanket 188 takes the form of a commercially available insulating material which is often used in the walls of buildings, in space suits, and in other applications. Disposed immediately above blanket 188 are polymer-extruded shaped components, such as component 190, which are preferably formed by extrusion molding. Disposed above these floor base components, and also preferably formed by molding, are overlying structures such as the one shown generally at 192 which are configured internally with void spaces that are useful to create ways and chases for the feeding of various utility structures in different directions for routing in building 100. The exact internal configurations of structures 192 may be made differently to suit different applications, and accordingly, the precise details of construction here are not further elaborated, inasmuch as they do not form a portion of the present invention.

In FIG. 14, shown generally at 194 are appropriate elongate runs of manifold-like utility feed structure required in building 100, such as feed structure for water, gas, high and low voltage electricity, telephone, cable, fire suppression and other things.

Immediately overlying structures 192 are tiles, such as the one shown at 196, which, in the particular building construction now being described, constitute the interior finished floor. In building 100, tiles 196 are formed of a conventionally available, so-called phase-change material which is effective to evenize the temperature inside building 100.

Focussing attention specifically on FIGS. 15 and 16, one can see that the lateral edges of tile structures 192 in the overall floor structure are formed with the special angular configuration pictured generally at 192*a* in FIGS. 15 and 16. Where the edges of the tile come essentially to the outside wall portion of building 100, these configured edge structures interlock with a molded extruded structure such as the one pictured at 198 in FIG. 15, each of which has the cross-sectional configuration clearly pictured in FIG. 15. Interconnection here, which is a reversible interconnection according to the invention between the outer edge of tile 192 and a structural member 198, is pictured at 200 in FIG. 15.

Where adjacent floor tile components meet within the interior of the building, such a meeting being generally pictured fragmentarily in FIG. 16, tile units 192 are interlocked with one another as is pictured generally at 202 in FIG. 16. Completing a description of what is shown in FIGS. 15 and 16, where previously mentioned wall panel structure 108 comes down to the foundation structure in the building, one of the outer defining frame members in that wall panel structure, shown at 204 in FIG. 15, which frame structure is made in accordance with the invention of an extrusion-molded polymeric material, the cross section of this part, clearly illustrated in FIG. 16, interlocks sturdily yet reversibly as shown generally at 206 with the immediately underlying confronting portions of the edge of tile 192 and member 198. Generally speaking, the type of interconnect connection which has just been mentioned at 206 in FIG. 15 is formed by confronting and mating connector elements having the respective cross-sectional shapes pictured in FIG. 18 in the drawings. While this arrangement of interconnecting connector components is pictured with one particular orientation in FIG. 15, and in a different particular orientation in FIG. 18, it will be apparent to those skilled in the art that this type of interconnect connection will be used at many points of component interconnection sites throughout the structure of building 100. A review of the drawing figures so far described, coupled with reviews of various drawing figures not yet specifically described, will show those skilled in the art clearly how and where such interconnect structures are distributed within building 100.

Looking again fairly specifically at FIGS. 15 and 16, one will note that, in the regions of connections previously identified with the reference numeral 202, the matingly interconnecting extruded components there pictured form an elongate, bounded void space within which various utility components, such as pipes and wires if desired, can be contained.

Still remaining with FIGS. 15 and 16, illustrated near the left sides of those two figures by elongate dashed lines which terminate with an arrow head, paths for water drainage that are provided both from upright wall and column structure and from horizontal floor structure downwardly into and through the foundation structure are illustrated. These drainage paths, which paths can also accommodate the normal flow of air, play an important role in minimizing the possibility in building 100 of an accumulation of water that can cause damage.

Figure 18:
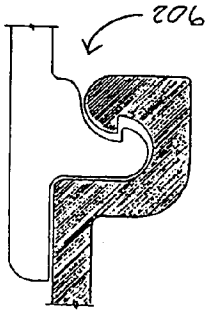
FIG. 18 is an enlarged, fragmentary detail illustrating one form of mateable, interconnectable connector elements that form one style of relative-motion-accommodating interconnect structure employed in accordance with the present invention. These connector elements are formed as integral portions of various different modular building components formed in accordance with the invention.

Focussing attention just for a minute again on the nature of the interconnection pictured especially in FIG. 18, one can see that this interconnection is designed in such a fashion that it will permit relative rotation, as for example within the plane of FIG. 18, between the associated integral components in the system, and additionally, can accommodate, within limited ranges, translational motion in all orthogonal directions. It is this feature of all the interconnect structures that form part of the present invention which produces the capability of interconnected components to move relative to one another by certain limited amounts, to accommodate the handling of matters such as externally applied loads and environmental temperature changes experienced by building 100.

Figure 19:
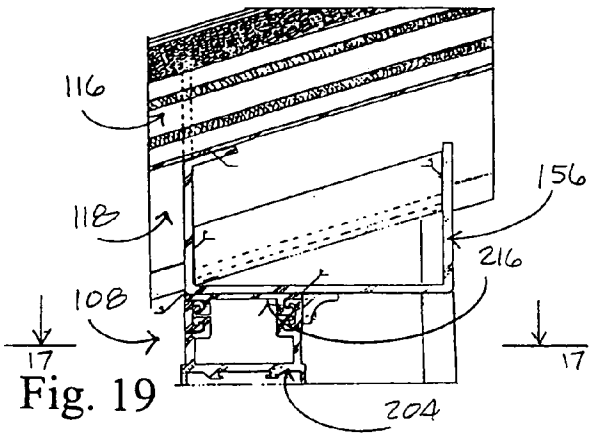
FIG. 19 is a fragmentary, cross-sectional view taken generally in the region embraced by the two curved arrows marked 19(20,22)–19(20,22) in FIG. 5, specifically showing the region of interconnection which exists in the building of FIG. 5 at the location where an external column and outside wall panels join with a rafter.
Figure 17:
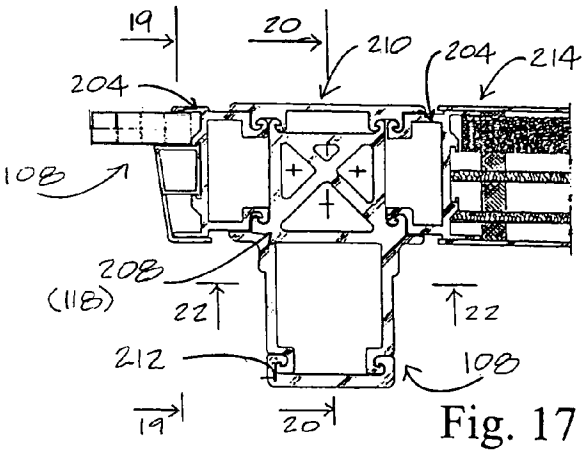
FIG. 17 is a cross-sectional view, through the structure shown in FIG. 20, on about the same scale as that employed in FIG. 14, illustrating, selectively (i.e., employed herein variously to picture two different kinds of otherwise similar structure), two different cross-sectional regions present in the building so far mentioned herein—one of such regions being examined from the point of view of looking downwardly at the cross section of an external, upright column and of associated, joined (interconnected) panel structures I that building, and the other region being examined from the point of view of looking along the long axis of an overhead rafter structure, and specifically where such rafter structure joins with two, spaced roof panels that form part of the mentioned building.
Figure 20:
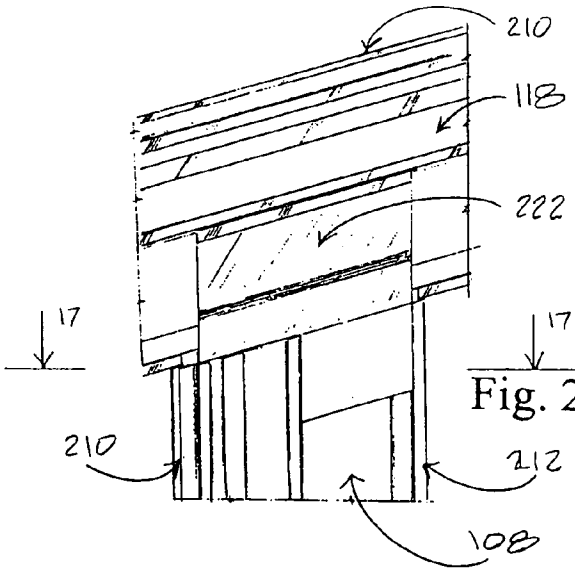
FIG. 20 is taken from a point of view and in a region also generally embraced by the two curved arrows 19(20,22)–19 (20,22) in FIG. 5, looking at and within a different plane of view which is displaced from, and generally parallel to, the respective planes of FIGS. 5 and 19.

Considering now together FIGS. 17, 19 and 20, and especially considering what is shown in FIG. 17 as being a view initially taken vertically along the axis of previously-mentioned column structure 114, that column structure includes what can be thought of as a central, elongate, extrusion-molded component which is given the reference numeral herein 208. FIG. 17 clearly shows the preferred cross section for this member, and one will notice that distributed at various locations on and about the outside of the perimeter of the cross section in this member are extending, integral connector elements like those pictured in previously-discussed FIG. 18. The outside portion of member 208 is capped by another extrusion-molded member 210, and the inner side of the column member is joined with another elongate, extrusion-molded member 212. Each of members 210, 212 is formed in accordance with the teachings of this invention to have the cross-sectional shapes clearly evidenced in FIG. 17, and when they are put into operative positions relative to member 208, they latch releasably and interconnect with that member as is shown in FIG. 17. Each of these connections, just as was true in the case of previously-mentioned connection 206, is characterized by offering limited ranges of relative angular and/or translational motion between components 208, 210, 212.

The right side of previously-mentioned wall panel structure 108 in FIG. 17 is effectively joined to column structure 114 through its right-side perimetral frame member 204 which is the same in cross-sectional configuration as was pictured for this kind of member at 204 in FIG. 15.

Shown on the right side of FIG. 17 is another panel structure 214 which is different in specific internal construction relative to panel structure 108, but which also includes a perimeter frame formed effectively of previously-mentioned members 204. The connection between column structure 114 and panel structure 214 are also clearly evident in FIG. 17.

Just as was true with respect to the operative interconnections established between components 208, 210, 212 as these are seen in FIG. 17, the connections which effectively exist through molded, elongate components formed in accordance with this invention that snap together to unite column structure 114 with panel structures 108, 214, permit the same general kinds of limited, but nevertheless consciously permitted, relative angular and/or translational motions in the assembled structure.

FIG. 19 illustrates the location of a horizontal beam such as previously-mentioned beam 156 shown in FIG. 7. The cross-sectional configuration of beam 156 is displayed clearly in FIG. 19, and through an appropriately joined underside elongate element 216, this beam joins with the upper perimeter frame member 204 in panel structure 108. An upper flange shown in FIG. 19 in beam 156 slidably engages the underside of a roof panel structure 116. Previously-mentioned rafter 118 is shown in the background of FIG. 19, and it will be evident from this, that beam 156, and all other like beams distributed in and throughout building 100, extend between adjacent rafters, lying immediately beneath and slidingly contacting the immediate overlying undersurface of the respective associated overhead roof panel structure.

The several interlocked connections pictured in FIG. 19, between the underside of beam 156 and the upper portion of panel structure 108, have the same relative-motion-accommodating qualities mentioned heretofore with respect to other specific structures.

As was mentioned earlier, FIG. 17 can be viewed as one that pictures a cross-sectional view of a rafter, such as rafter 118, joined with a pair of roof panel structures which may in construction be very much like panel structures 108, 214 which are illustrated in FIG. 17. At this location in the structure of building 100, it will thus be evident that the interconnections which thus exist at the locations of the rafter structures and the associated, laterally adjacent roof panel structures are relative motion interconnections having all of the qualities and performance characteristics of the other like interconnections mentioned so far herein specifically.

On another note with respect to what is shown in FIG. 17, if one now uses FIG. 17 to illustrate a view taken generally upwardly and toward the peak of building 100 and along a rafter such as rafter 118, three cross-hatched pairs of lines, pictured in what are shown as void spaces in the cross section of the central rafter element, represent the locations of appropriate resin-set bolts that anchor the inner, upper central ends of the rafters to previously-mentioned ridge structure which is contained in the area of curved arrows 28—28 in FIG. 7.

It should thus now be growingly apparent, that there are formed in accordance with this invention, for incorporation at different locations, and for different specific purposes within an overall building structure, such as building 100, elongate, preferably extrusion-molded polymeric structural elements equipped with integral, somewhat hook-like connector elements that are brought together in a snap-together fashion during building assembly to create structurally sturdy interconnections between relevant components in a building, and which also furnish the desired limited-range capability for angular and/or translational relative motion.

Figure 21:
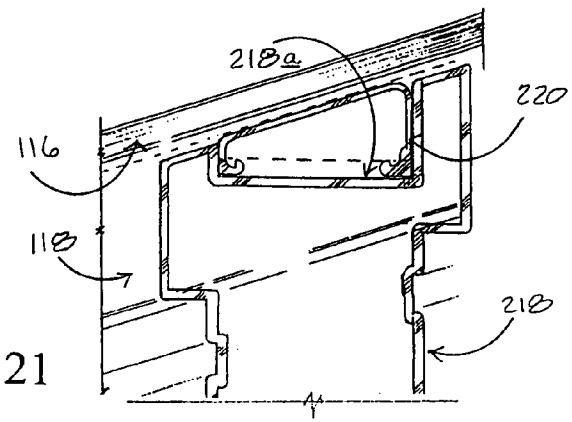
FIG. 21 is a view, on about the same scale as that employed in FIGS. 19 and 20, showing a region of intersection between a portion of an interior wall in the building of FIGS. 1, 2, 5 and 7, and part of the roof structure in this building. This region of intersection is one that permits relative sliding motion (of the stress-relief kind generally required by temperature changes) between such a wall and roof structure.

FIG. 21 illustrates the confronting condition which exists along the upper edges of internal wall structures in building 100. Specifically, shown at 218 in FIG. 21 is a plastic-molded configured member which is snap fit to the upper frame member, like previously-mentioned frame members 204, in the associated wall, to extend upwardly and provide for sliding engagement with the underside of the immediate overlying roof structure. Member 218 is appropriately formed with an upwardly facing elongate socket, such as that pictured generally at 218*a* in FIG. 21. This socket receives an appropriate cushioning element pictured generally at 220 in FIG. 21. It should be understood that the specific kind of snap-fit interconnection which exists between member 218 and the associated underlying wall panel is not specifically illustrated in FIG. 21, but would take the form generally of interconnections of the sort pictured for example in FIG. 17 at the lower side of that figure.

Figure 22:
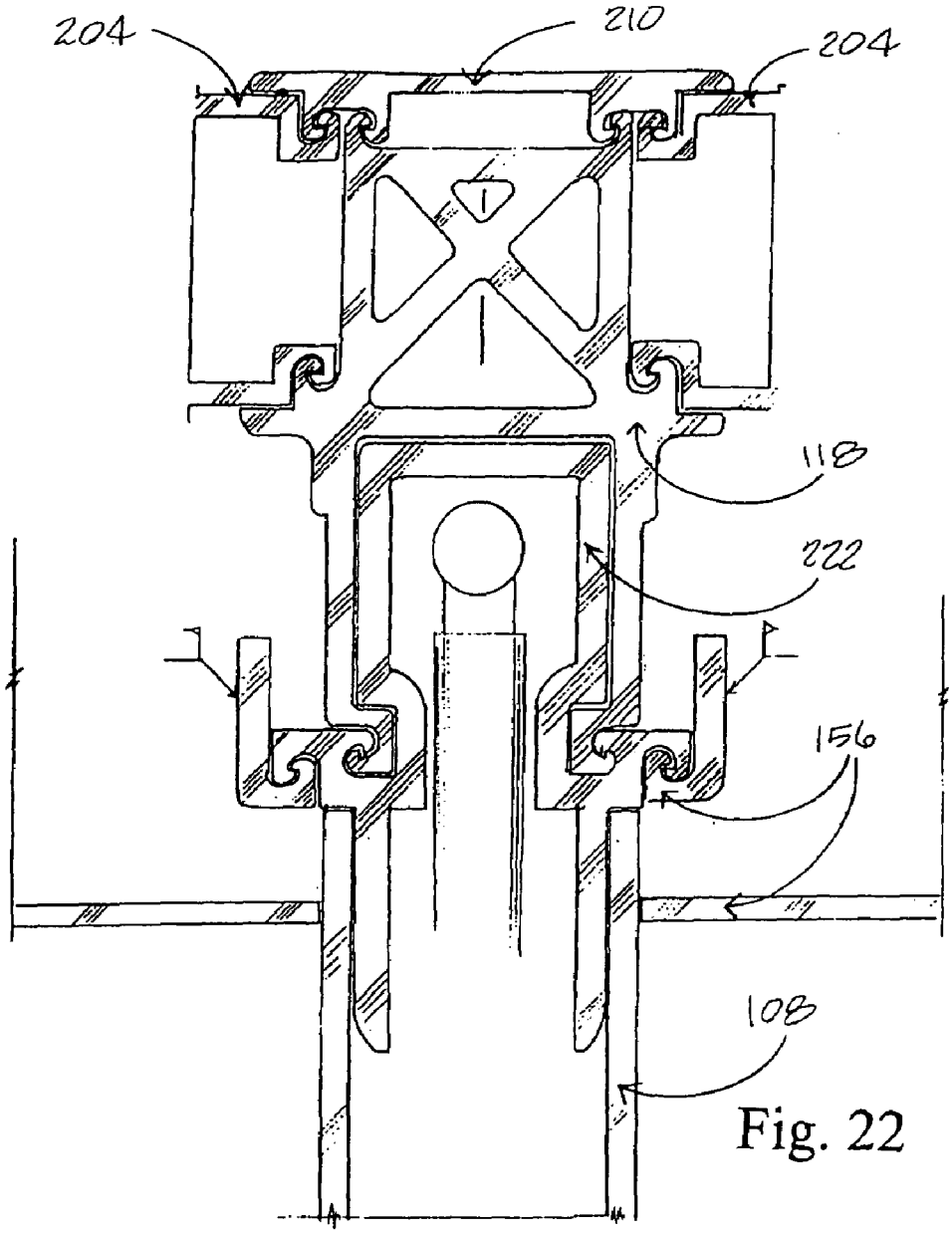
FIG. 22 is an enlarged, fragmentary, cross-sectional view, also taken generally in the region embraced by curved arrows 19(20,22)–19(20,22) in FIG. 5, and looking into a plane which extends through that region with a disposition that is substantially normal to the plane of FIG. 5.

In FIG. 22 we see a fragmentary vertical cross section through column structure 108 and other related, interconnected structures. Anchored in any suitable fashion, as by chemical bonding, in the upper reaches of the central stem portion of column 108 is a specially configured capping member 222 which joins as shown snappingly and in an interlocked condition with previously-mentioned rafter structure 118. Other components shown in FIG. 22 are several of those other components described in the descriptions just above with respect to FIGS. 17, 19, 20 and 21.

Figure 23:
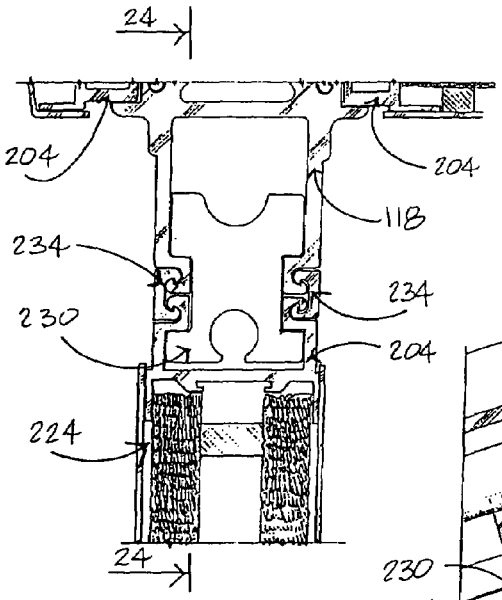
FIGS. 23, 24 and 25 are fragmentary, cross-sectional views generally illustrating a typical region of intersection and interconnection between a rafter, roof structure and a wall structure.
Figure 24:
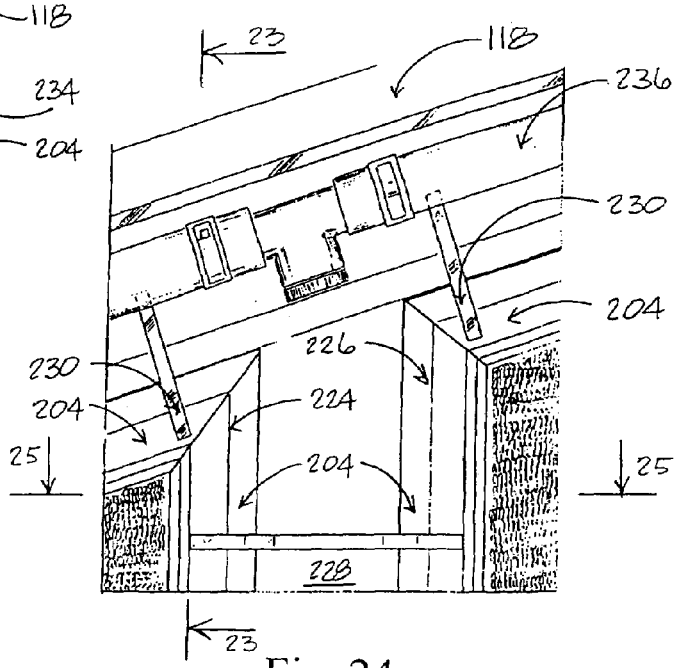
Figure 25:
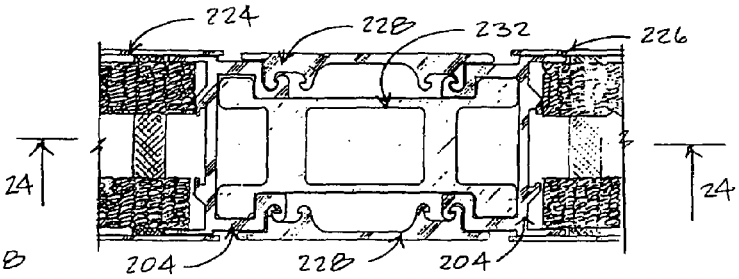

Turning attention now to FIGS. 23–25, inclusive, here what is pictured are several related views, sectional details, illustrating a region of interconnection between rafter structure 118, and a pair of laterally adjacent wall panels that reside immediately beneath this rafter. The two wall panels involved in these views are numbered 224, 226. The upper sides of these panels are appropriately angled, as the panels are viewed from the side, in order that they will match the angular configuration within the building at the location wherein they are installed. Accordingly, perimeter frame members 204, at the upper reaches of these wall panel structures, are appropriately angularly cut at their ends as are the upper ends of the laterally-defining panel frame members, so that these panel frame members come together to form a matching coherent perimeter frame relative to the specific regions where they are intended to be used in building 100.

Referring especially to FIG. 25, yet another elongate, extrusion-molded polymer plastic component made in accordance with the invention, which component is employed at various appropriate locations to define part of a spanning interconnection between adjacent wall panels, is shown in two locations at 228 in FIG. 25. Components 228 which, as was just mentioned, are employed at various other locations distributed throughout the building 100, coact with the other components which they interconnect, and specifically components 204, as pictured in FIG. 25 to permit the same kind of limited-range relative motion discussed earlier.

Completing the description of interconnect structures pictured in FIGS. 23–25, inclusive, shown at 230 in FIGS. 23 and 24 are two independent molded plastic connectors having the cross-sectional configuration clearly pictured in FIG. 23, and operating to perform internal interconnections between upper panel frame members 204 and the inside of portions in rafter structure 118.

Pictured at 232 in FIG. 25 is another independent-molded plastic interconnect member which, as such is seen in FIG. 25, spans the space between wall panel structures 222, 226 to interconnect these two panel structures via internal engagement within what can be thought of as the exposed interiors of the two confronting panel frame members 204 that are clearly pictured in FIG. 25.

Finally, shown at two locations in FIG. 23 are additional independent interconnect members formed in accordance with the present invention, and these members, as such are shown in FIG. 23, interconnect connector elements exposed in the confronting portions of panel frame members 204 and rafter 118 as shown.

Digressing for a moment to another sort of structure which is present in building 100, indicated generally at 236 within the structure (interior) of rafter 118, are fluid flow components which make up a portion of a fire-suppression system which is conveniently routed through the structural elements of the present invention and within the confines of building 100.

Still referring to the structures of connectors 230, 232, one will note on looking at them in the drawings that they are formed effectively which would end up to be accommodating clearance passageways toward their opposite ends which allow for the separation and routing of, for example, conduits carrying water and conductors carrying electricity. This important approach which leads to internal separation of such two potentially dangerously conflicting structures is made present throughout building 100 as accommodated by the unique cross sections of the various modular building elements formed in accordance with the invention.

Generally in the region of the location of capping structure 244, and if desired, appropriate openable and closeable vents or ports may be provided which will act with venturi behavior in building 100 to promote effective air flow into and through the building.

Figure 26A:
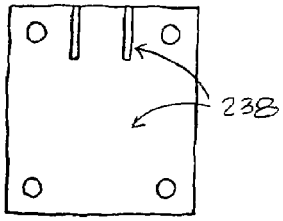
FIGS. 26A, 26B are simplified and isolated views illustrating, respectively, a plan view and an elevation view of the point of connection existing at the region of joinder between two building end wall panels in the building of FIGS. 1, 2, 5 and 7, and at the location generally of the floor structure and the underlying supporting foundation structure.
Figure 26B:
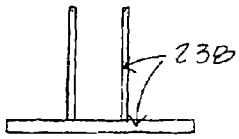

FIGS. 26A, 26B illustrate, in plan and in elevation views respectively, and isolated from other structures, is an anchoring plate which is employed at the opposite gable ends of building 100, and immediately beneath the regions of joinder between adjacent outside end wall panels, to anchor the assemblage of these panels suitably to the underlying structure in foundation 102, without requiring a full column.

Figure 27:
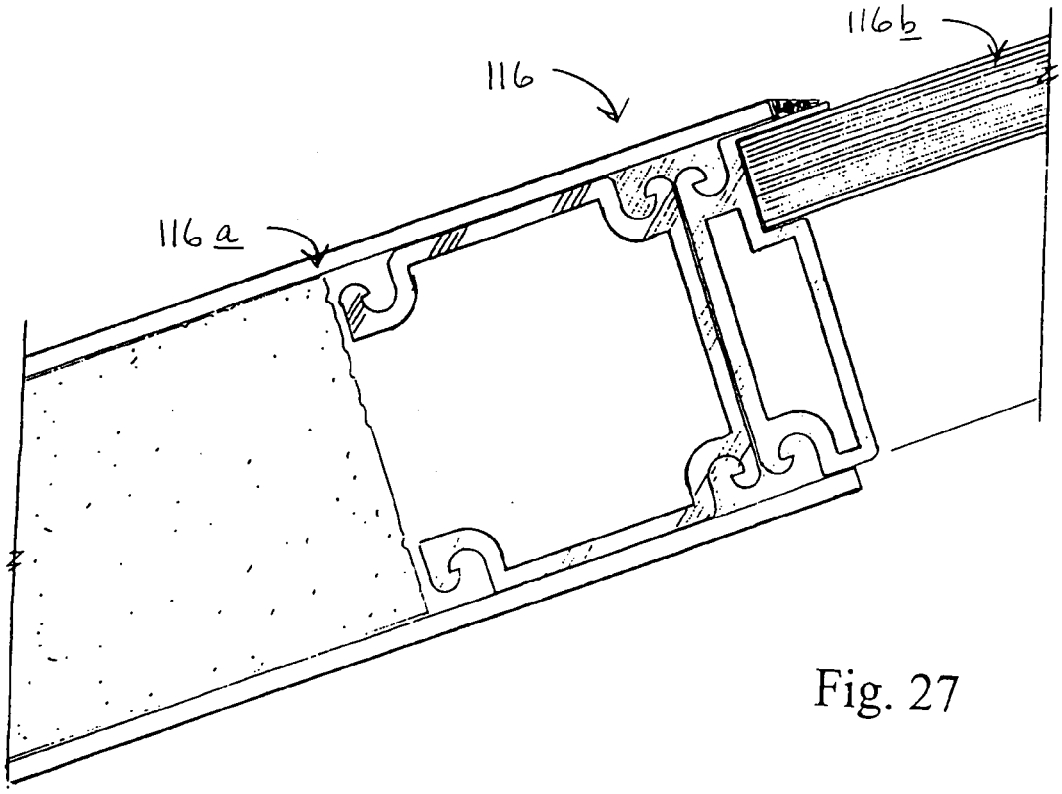
FIG. 27 is an enlarged, fragmentary view illustrating a portion of one style of a roof panel employed in the building structure depicted so far, such panel being characterized by two different kinds of panel subsections that are joined within the illustrated overall panel.

Turning attention now to FIG. 27, here there is shown in isolated fragmentary form a portion of previously-mentioned roof panel structure 116. This panel structure, as such is illustrated herein, is formed to have two different types of panel areas. FIG. 27 specifically illustrates how these two different panel areas, generally shown by arrows 116*a*, 116*b* in FIG. 27, are interconnected according to the use of extrusion molded components formed in conjunction with implementation of the present invention.

The exact natures of these two different characteristics in a single roof panel are completely a matter of choice, and FIG. 27 is simply provided as a general illustration of how such differentiated panel characteristics can be created in a single spanner panel constructed in accordance with this invention.

Focussing attention now specifically on FIGS. 28–33, inclusive, here one finds a plurality of largely, self-explanatory views that illustrate one modification of ridge structure formed in accordance with the present invention, and included in building 100 generally in the region previously mentioned, and contained within curved arrows 28—28 in FIG. 7. What is specifically pictured in these several views is a ridge structure which has been equipped, in accordance with an optional feature that happens to be included within building 100 to produce motorized motion and transport of various kinds of sliding panels and/or screens in the roof structure of building 100. All of the details of all of the componentry pictured in these figures are not specifically discussed herein, inasmuch as these views are, as was just mentioned, quite self-explanatory.

Figure 28:
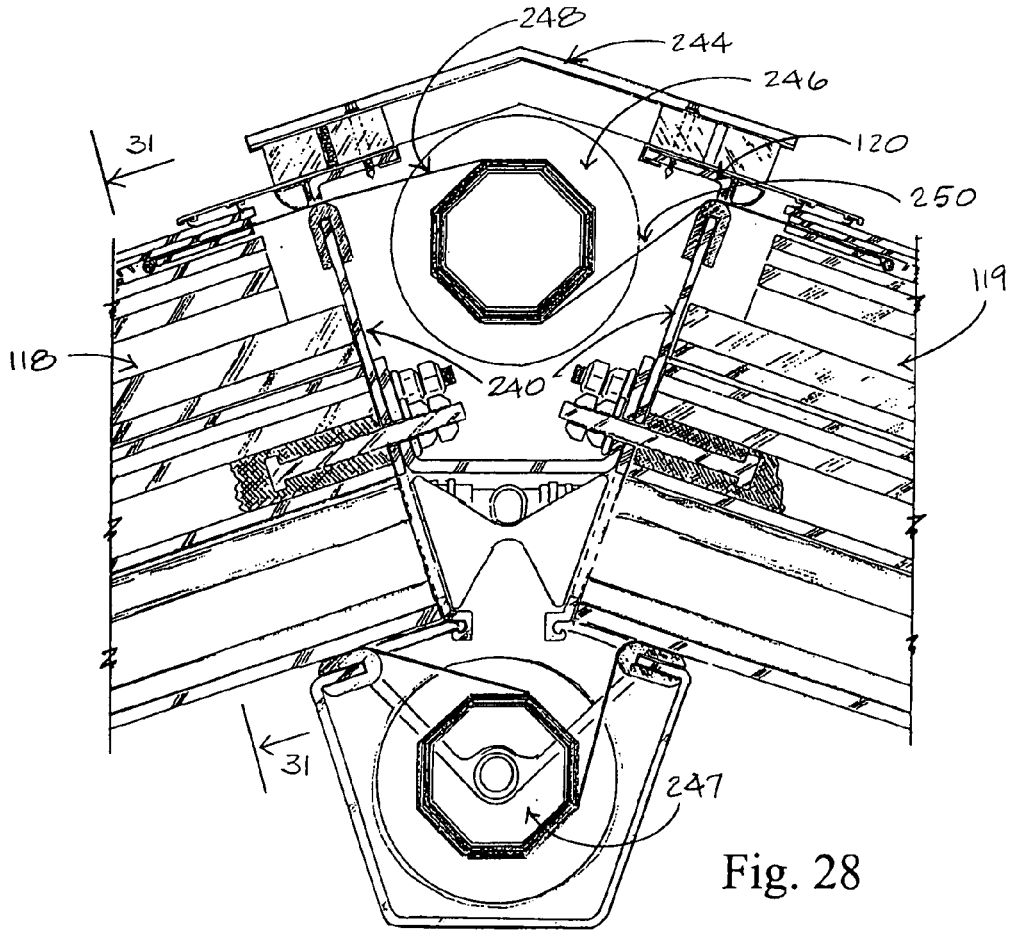
FIG. 28 is a view taken generally in the region of curved arrows 28—28 in FIG. 7 illustrating details of construction of one embodiment of ridge structure, including optional panel, screen, etc. motion structure, constructed in accordance with the invention, and present in the building of FIGS. 1, 2, 5 and 7.

Assuming that the view presented in FIG. 28 is taken in the plane containing previously discussed rafter structure 118, one can see that this rafter structure (shown on the left side of FIG. 28) extends toward the ridge area in building 100 where it confronts a similarly extending rafter structure 119 that extends toward the ridge region of the building from the right side of FIG. 28. The confronting ends of these two rafter structures are anchored as by bolting to a pair of plates shown at 240 in FIG. 28, which plates are angularly disposed relative to one another as is shown, and form part of previously mentioned roof ridge beam structure 120. Appropriate ridge capping structure 244 extends over the ridge area along the length of the building.

Appropriately disposed within the upper reaches of the void space defined within the interior of ridge beam 120, and pointed to generally by arrow 246 in FIG. 28, is a motorized rotary take-up and pay-out drum and line structure, including lines that are shown extending toward opposite lateral sides of the building, generally at 248, 250. This line structure is connected to appropriately mounted roof panel structures that are designed for sliding motion back and forth within the roof structure. There are various and many ways in which such slidable and movable roof panel structure components can be fabricated, and accordingly, and since the details of these constructions form no particular part of the present invention, these details are omitted from illustration and discussion specifically herein.

Figure 29:
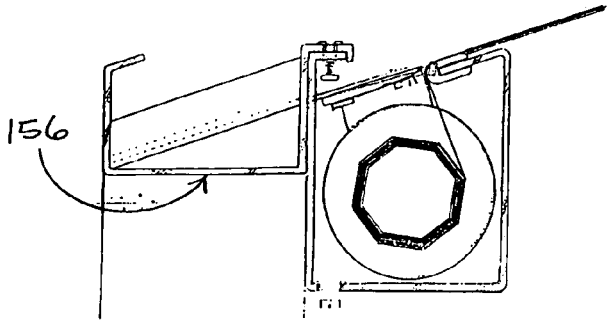
FIGS. 29, 30 are isolated and functionally related fragmentary details illustrating other component structure which is associated with the motion structure that is pictured in FIG. 28.
Figure 30:
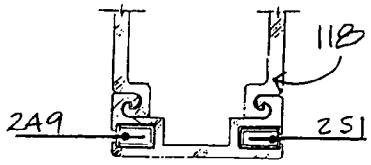

Still with reference to FIG. 28, and now including additional reference specifically also to FIGS. 29, 30, pictured generally at 247 in FIG. 28 is a motorized rotary take-up and pay-out drum and line structure which is employed in building 100 to control the motions of two laterally-disposed screens that are provided as an option in building 100. In many ways, this motorized structure is similar to the one previously and briefly discussed just above. FIGS. 29 and 30 show, respectively, a spring-loaded take-up and pay-out drum structure that is located basically at the left side of the building structure as such is pictured in FIG. 28, and specifically at the location of previously-mentioned eave beam 156. This structure functions to react against turning operation of a motorized structure 247 in FIG. 28.

FIG. 30 is a fragmentary view illustrating guideways that are provided on opposite sides of previously-mentioned rafter 118 to guide the sliding back-and-forth motions of two screens which, in FIG. 30, are shown at 249, 251.

Figure 31:
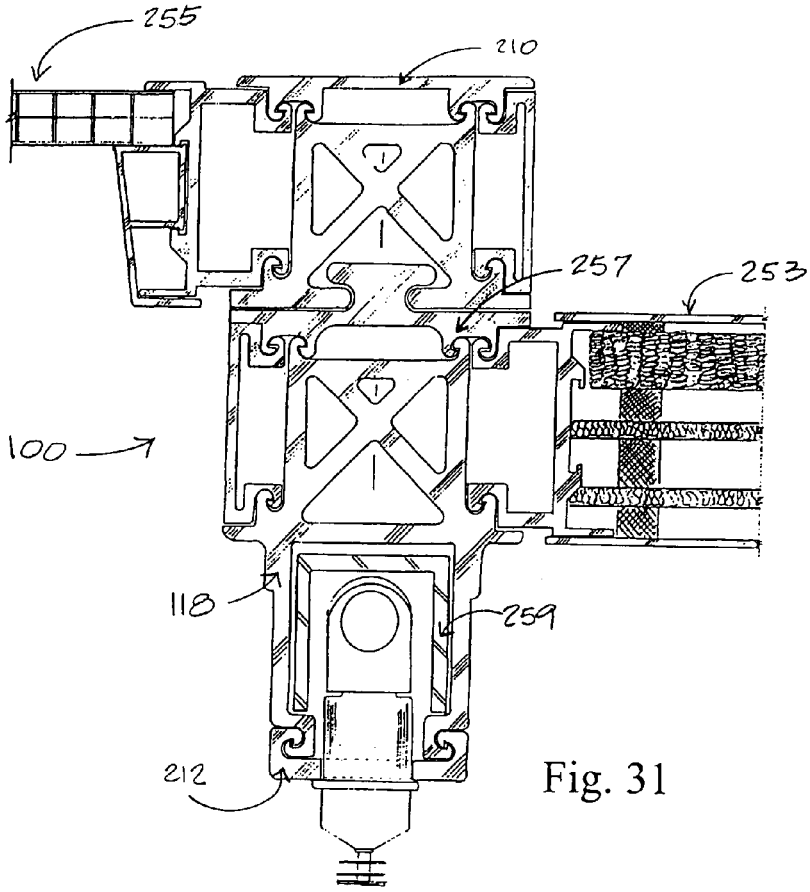
FIG. 31 is a fragmentary cross-section taken generally along the line 31—31 in FIG. 28.

FIG. 31 which is taken, as was mentioned, cross-sectionally along line 31—31 in FIG. 28, shows the interconnections between the various components which rise towards the ridge structure on the left side of FIG. 28, and illustrates a large collection of the same kind of relative motion interconnect structures previously described hereinabove. In addition, FIG. 31 offers a clear illustration of the defining operative boundary between non-moving roof structure, shown generally at 253 in FIG. 31, and slidably moveable roof structure shown at 255 in FIG. 31, all relative to previously-mentioned rafter 118.

Looking again for a moment to FIG. 31, indicated generally at 257 is an extrusion-molded component prepared in accordance with the present invention which acts as a way or guide for sliding movement of sliding roof structure 255. Pictured at 259 in FIG. 31 is an optional elongate internal reinforcing stiffener, preferably made of a suitable metal material, fitted within a region in rafter 118.

Figure 32:
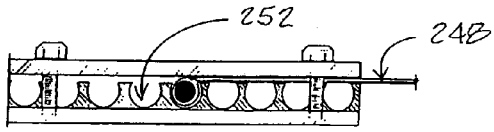
FIGS. 32, 33 are isolated and fragmentary details illustrating other components in the motion structure generally otherwise pictured in previously-mentioned FIGS. 28, 29 and 30.
Figure 33:
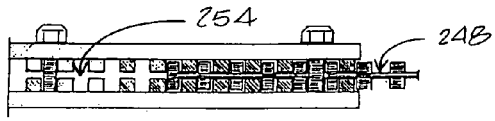

Returning for a moment to previously-mentioned lines 248, 250, these lines extend toward adjustable connector structures, pictured in two different appropriately usable forms in FIGS. 32, 33 especially for line 248. As can be seen from looking at FIGS. 32, 33, one can discern how it is possible to adjust the anchored outer ends of lines 248, 250 relative to the associated moving roof panel structures.

Figure 34:
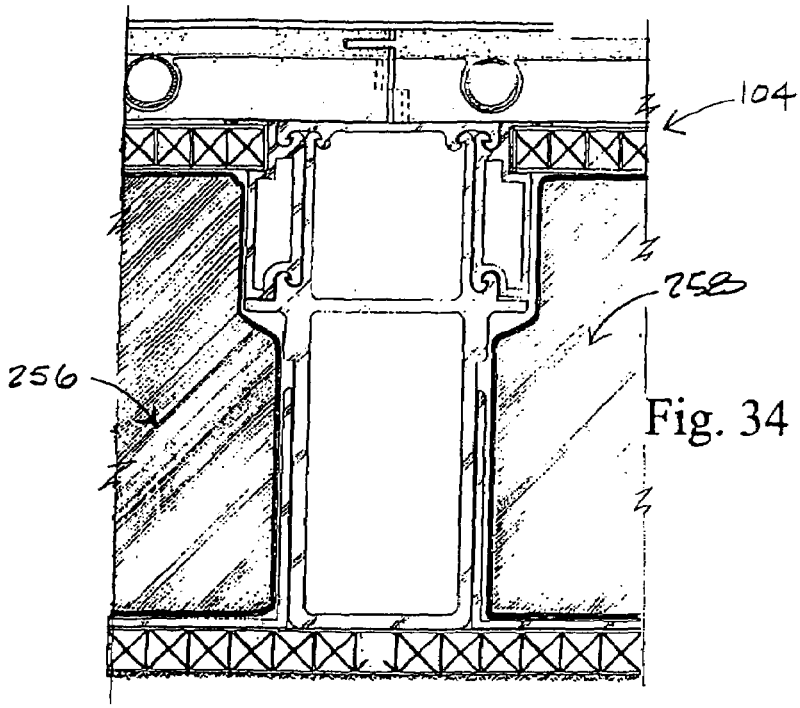
FIGS. 34 and 35 are enlarged, fragmentary views illustrating, respectively, a vertical section and a horizontal plan view of portions of a water-reservoir system constructed according to one modification of a system implemented in accordance with the present invention.
Figure 35:
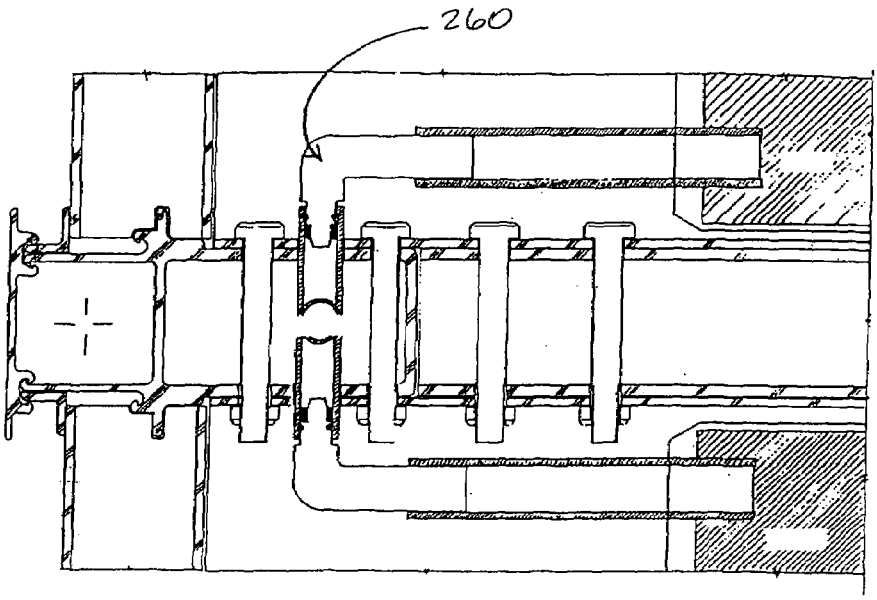

Turning attention now briefly to FIGS. 34, 35, here illustrated fragmentarily in cross-sectional elevation and plan views, respectively, and looking generally into the region underlying floor structure 104, is what is referred to herein as water reservoir structure including water-containing bladders 256, 258. These bladders are appropriately fit into suitable accommodating spaces provided effectively either within or underneath floor structure 104, and appropriate routed interconnect plumbing for these bladders is generally pictured at 260 in FIG. 35.

The exact constructions, configurations, locations and interconnections provided for such a water reservoir structure are, in their various possible details, no specific part of the present invention, can be constructed and rendered in a number of different ways at the choice of a building designer and in relation to a specific application, and accordingly, need not be, and are not, discussed in detail herein. Suffice it to say that such a water reservoir structure creates the opportunity to have a large volume of contained water located in a building, such as building 100, adjacent the floor and foundation in the building to function for various different purposes. Mentioned earlier herein are three of these purposes. One of them is to provide a water reservoir system which can couple through suitable appropriate fluid conduits that are extended within the confines of the building components of this system toward overhead plumbing, such as that which is pictured in FIG. 24 at 236, to furnish an integrated fire-suppression system. Another use is to furnish such a system through which appropriate heated pipes can be conducted to utilize stored water as a heat sink for the purpose of controlling environmental temperature within the confines of a building like building 100. Yet a further purpose is associated with furnishing substantial weight in an overall building structure to help anchor it against catastrophic motion relative to the underlying ground in a circumstance, for example, of a severe storm or a condition such as a hurricane or tornado, and especially with respect to a building which is supported on top of the ground, and without the presence of any ground-penetrating foundation structure, such as the ground-penetrating foundation structure 102 that has been discussed so far herein.

FIGS. 36–39, inclusive, illustrate other kinds of appropriate foundation structures, including a pair of such foundation structures with respect to which the weighting possibilities of a water reservoir system may be especially useful.

Figure 36:
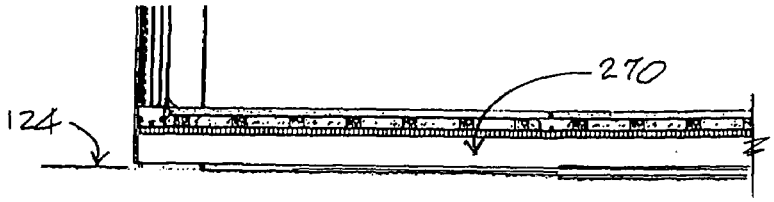
FIGS. 36, 37 individually, and FIGS. 38, 39 collectively, illustrate several different alternative embodiments of foundation structure for a building which is otherwise like the building pictured in FIGS. 1, 2, 5 and 7. These different embodiments deal specifically with different specific ground-contacting, and structure-elevating, approaches to building construction.

FIG. 36 illustrates a non-ground penetrating and substantially ground-resting foundation structure 270 which is shown resting directly on the upper surface of ground 124.

Figure 37:
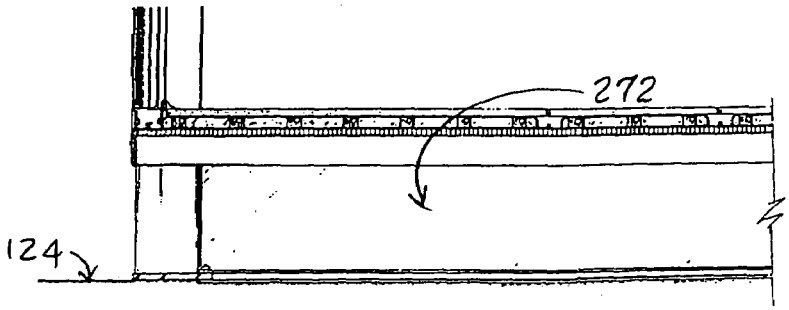

FIG. 37 illustrates a foundation structure 272 which is also a ground-resting non-penetrating foundation structure that differs from the one pictured in FIG. 36 by providing for a predetermined desired elevation, such as that illustrated generally at E in FIG. 37, of the superstructure in the building relative to the upper surface of the ground.

Figure 38:
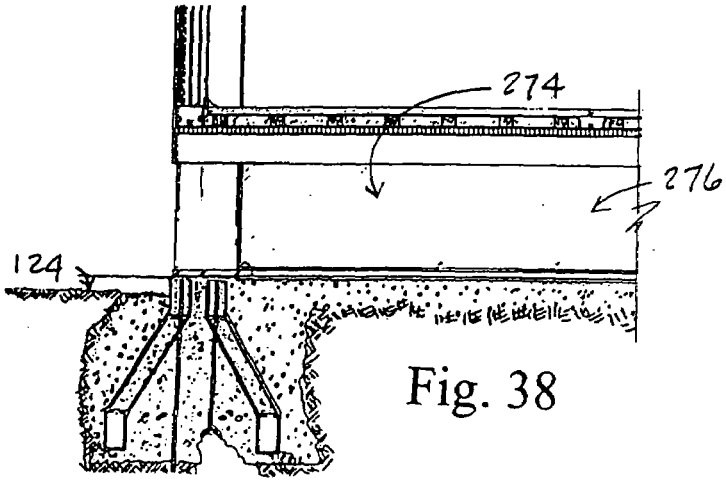
Figure 39:
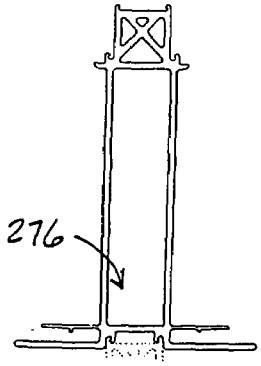

Finally, FIGS. 38, 39 collectively illustrate yet a third form of foundation structure 274 which is similar in many respects to foundation structure 102. Foundation structure 274 differs from structure 102 by including modular elevation components, such as that pictured at 276 in FIGS. 38, 39, which additional elevational structure rests upon, and is appropriately anchored to, the upper portions of a foundation structure part which is very much like previously-described foundation parts 158.

Figure 42:
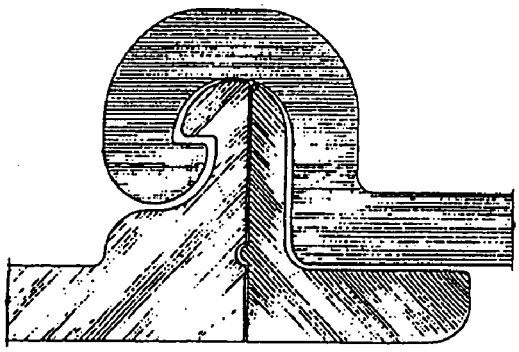
FIGS. 40–42, inclusive, are fragmentary details, each very much like the detail pictured in previously-discussed FIG. 18, showing three different modifications of connector elements that can be employed in interconnect structure prepared in accordance with the features of the present invention.
Figure 41:
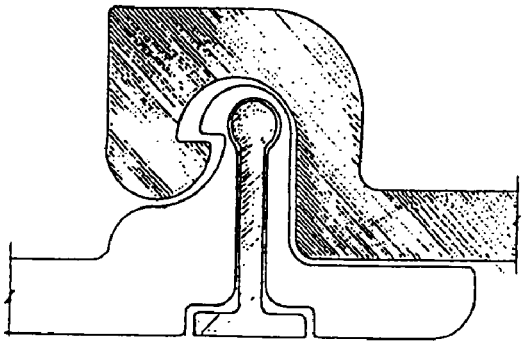
Figure 40:
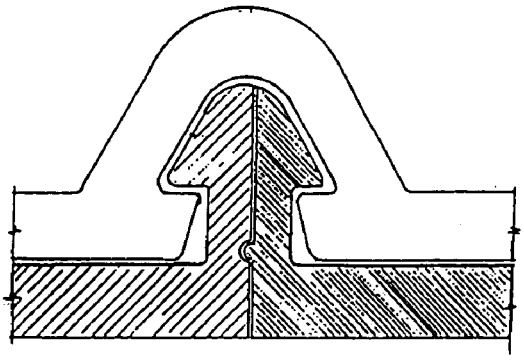

Touching now just briefly on each one of the additional enumerated drawing figures presented herein, most of which, with simple introductory statements made herein, will become immediately understood by those skilled in the art reading these drawing figures, FIGS. 40, 41, 42 show three different modifications of appropriate relative-motion accommodating interconnect structures that can be formed in the molded components in accordance with the present invention. The specific structures shown in detail in FIGS. 40, 42 essentially illustrate interconnect structures wherein one side, so-to-speak, of the mating interconnecting componentry is split into two parts as shown. The structure illustrated in FIG. 41 is one wherein a locking key or element can be removably inserted into one of the two mating components to inhibit accidental disconnection or withdrawal of connection.

Figure 43:
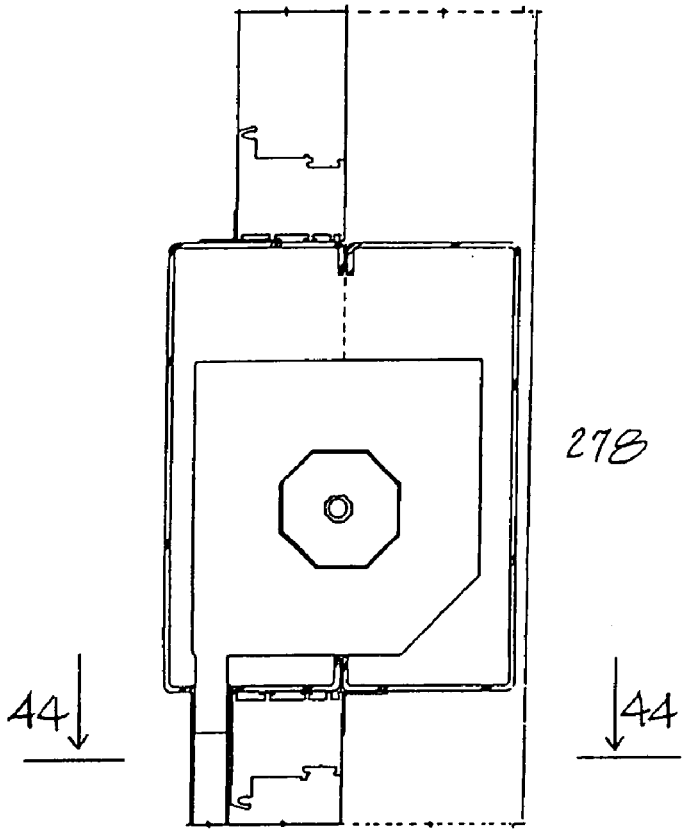
FIGS. 43, 44 are, respectively, vertical-plane and horizontal-plane sectional views illustrating components in vertical wall structure employed to create motions in shutters or screen modifications that are employable in a building constructed with the system of the present invention.
Figure 44:
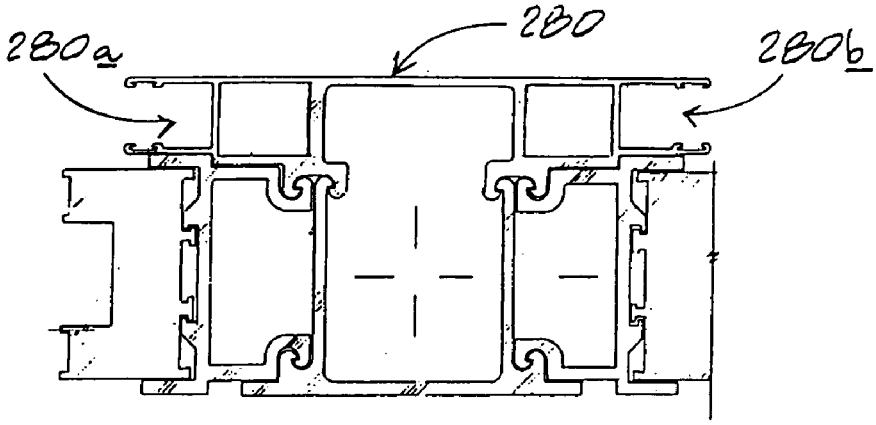

FIGS. 43 and 44 illustrate in elevational-section and plan-section views, respectively, fragments of modified portions of a building structure wherein motion structure is provided within an upright wall panel structure. The motorized portion of such a modification is pointed to generally at 278 in FIG. 43. FIG. 44 shows yet another type of elongate extrusion molded polymer plastic component 280 which is formed in accordance with the present invention, and is snap fit into place in the region intermediate a pair of upright wall panel structures to provide connection channels 280*a*, 280*b*, wherein appropriate guides or slide-accommodating tracks, for example, moveable screens can be driven by the motorized structure pictured at 278 in FIG. 43.

Figure 45:
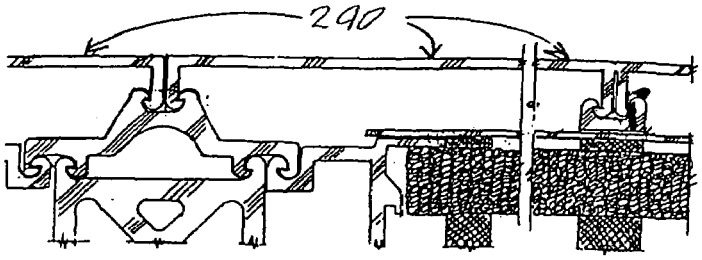
FIGS. 45–48, inclusive, are different fragmentary views generally illustrating certain components constructed in accordance with the present invention, and usable in a modified form of building construction which also employs certain otherwise conventional building materials. These views generally show and suggest how various such other materials can integrate easily into a building constructed in accordance with the invention.

FIG. 45 illustrates in fragmentary cross section how several kinds of specifically cross-sectionally configured members constructed in accordance with this invention can be used to receive specially formed exterior building skin structure made in panels, such as the panels shown generally at 290 in FIG. 45.

Figure 46:
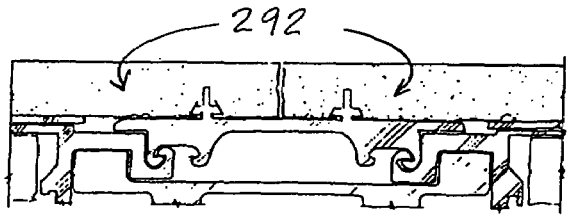
Figure 47:
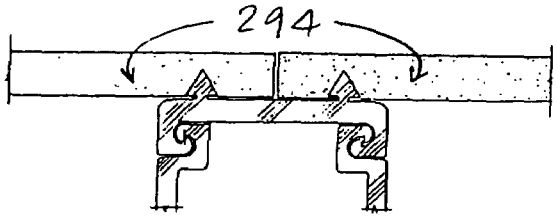

FIGS. 46, 47 illustrate the use of molded interconnect structures formed in accordance with the present invention adapted to receive, at different locations within a building such as building 100, conventional wall material, such as sheetrock material generally pictured at 292, 294 in FIGS. 46, 47 respectively.

Figure 48:
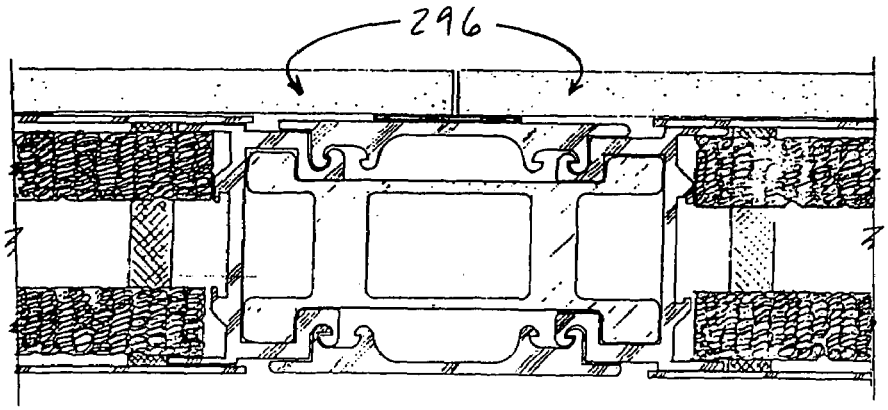

FIG. 48 is a fragmentary section taken in the region where two wall panel structures, for example, are joined through interconnect structure of the type described earlier herein, on the outside of which there are provided structural-tape-attached sheets of conventional sheetrock or wallboard, pictured at 296 in FIG. 48.

Figure 50A:
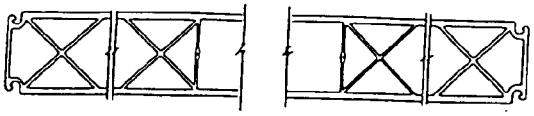
FIGS. 49, 50A, 50B and 51 are simplified, and in certain instances exploded and fragmented, views of the construction of a panel structure which can be built substantially completely by extrusion molding, and as a whole (a singularity), in accordance with the present invention.
Figure 50B:
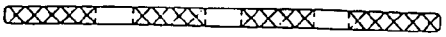
Figure 51:
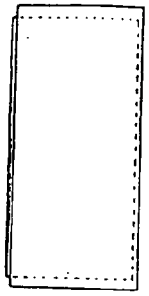
Figure 49:
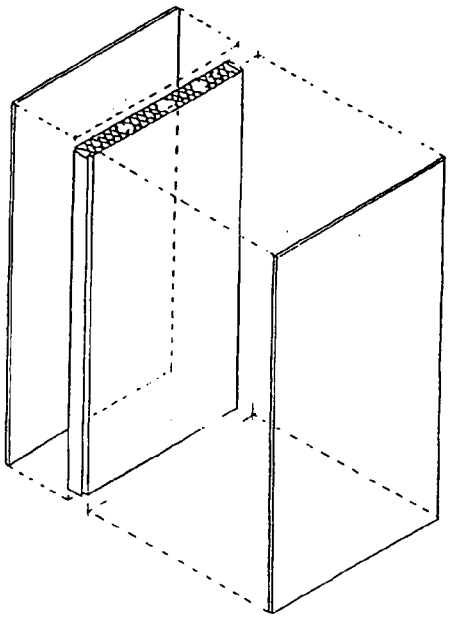

FIGS. 50*a*, 50*b* illustrate, in different drawing scales, constructions of extrusion molded spanning panel structures that can be formed in accordance with the present invention, and FIGS. 51, 49, in conjunction with these two other figures, picture how an overall panel structure including opposite facial spaced skin structures can be created.

Figure 52:
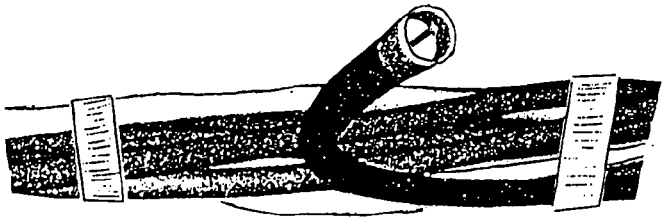
FIG. 52 is a fragmentary, enlarged detail illustrating a novel power-conductor bundle arrangement employed according to the present invention in a building such as the building illustrated in FIGS. 1, 2, 5 and 7.

FIG. 52 is a fragmentary view of a novel power-supplying cable bundle proposed for incorporation into a building in accordance with the present invention. In this bundle, there is provided but one single neutral line, one single ground line, and an appropriate plurality of higher-voltage lines.

It should now be apparent that a novel modular building system is proposed and has been illustrated and described with respect to the present invention. All of the important structural and other features offered by this system have been discussed very fully earlier in this specification, and are clearly contributions to the relevant art which promote the constructing of very versatile, easily and quickly installed, highly-efficient building structures.

It is desired to claim and secure by Letters Patent:

1. A modular building system for constructing a substantially plastic building, comprising plastic walls erected in substantially parallel planes, a roof system spanning the walls, the roof system including a ridge beam structure, plural extruded plastic rafters, each rafter being connected to the ridge beam and extending normal to the ridge beam in a sloping orientation toward one of the walls, each rafter having opposing lateral sides, and a top side facing the outside of the building, a first rafter of the plural extruded plastic rafters having two external corner portions, each external corner portion having a hook-shaped projection, first and second extruded polymeric roof panels configured for connection to the opposing lateral sides of the first rafter to form an inclined roof structure, each roof panel having a hook-shaped projection on an edge adjacent the first rafter, a cap member configured for mounting over the top side of the first rafter, the cap member having cap channels for mating each of the hook-shaped projections on the first and second roof panels to corresponding hook-shaped projections on the external corner portions of the first rafter, the roof panels being securely held in place relative to the first rafter when the cap member is securely engaged over the top side of the first rafter.

2. The building system of claim 1, wherein the roof system permits the roof panels to be laid down between rafters prior to securing the cap member on the top side of the first rafter.

3. The building system of claim 1, wherein each of the roof panels has a frame structure, the hook-shaped projection being formed in the frame structure.

4. The building system of claim 1, wherein the first rafter is bolted to the ridge beam.

5. The building system of claim 1, wherein the hook-shaped projection on each roof panel shares a cap channel with the corresponding hook-shaped projection on the rafter.

* * * * *